US009333663B2

(12) United States Patent
Okuyama

(10) Patent No.: US 9,333,663 B2
(45) Date of Patent: May 10, 2016

(54) CUTTING APPARATUS AND NON-TRANSITORY COMPUTER-READABLE MEDIUM

(71) Applicant: BROTHER KOGYO KABUSHIKI KAISHA, Nagoya-shi (JP)

(72) Inventor: Tsuneo Okuyama, Inabe-gun (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 136 days.

(21) Appl. No.: 14/445,643

(22) Filed: Jul. 29, 2014

(65) Prior Publication Data

US 2015/0027285 A1 Jan. 29, 2015

(30) Foreign Application Priority Data

Jul. 29, 2013 (JP) ..... 2013-156684

(51) Int. Cl.
*B26D 5/00* (2006.01)
*B26F 1/38* (2006.01)

(52) U.S. Cl.
CPC ..... *B26D 5/00* (2013.01); *B26F 1/3813* (2013.01); *Y10T 83/141* (2015.04); *Y10T 83/173* (2015.04); *Y10T 83/869* (2015.04)

(58) Field of Classification Search
CPC ..... B26D 5/00; B26D 5/005; B26F 1/3813; Y10T 83/173; Y10T 83/141; Y10T 83/869
USPC ..... 83/409, 418, 426, 428, 429, 436.1, 438, 83/614, 28
See application file for complete search history.

(56) References Cited

U.S. PATENT DOCUMENTS 3,596,068 A * 7/1971 Doyle ..... G06Q 10/043 33/11
5,743,164 A * 4/1998 Guez ..... B26D 5/00 234/107
5,831,857 A * 11/1998 Clarino ..... B26D 5/007 178/18.01
6,810,779 B2 * 11/2004 Feldman ..... B26D 5/00 700/134
2007/0240548 A1 * 10/2007 Pape ..... B26D 5/00 83/76.1
2009/0019979 A1 * 1/2009 Kimura ..... B23B 29/125 83/72
2012/0048085 A1 * 3/2012 Farnworth ..... B23K 26/4075 83/72
2012/0210836 A1 * 8/2012 Wiggins ..... B26D 1/0006 83/13
2013/0008292 A1 * 1/2013 Kawaguchi ..... B26D 5/005 83/76.1

(Continued)

FOREIGN PATENT DOCUMENTS

JP 2004-261916 A 9/2004
JP 2005-279957 A 10/2005

(Continued)

*Primary Examiner* — Sean Michalski
(74) *Attorney, Agent, or Firm* — Fox Rothschild LLP

(57) ABSTRACT

A cutting apparatus includes a moving device configured to move a cutting blade and an object in a first direction and in a second direction differing from the first direction, relative to each other and a control device configured to cause the apparatus to calculate first cutting time lengths required to cut a pattern at a plurality of arrangement angles when an arrangement angle of the pattern relative to the first or second direction is changed by a first unit angle, determine one of the arrangement angles, which is shortest with respect to the first cutting time length or not more than a first threshold, and control the moving device so that the movement of the cutting blade in the first direction and the movement of the object in the second direction are simultaneously executed, with a result that the pattern is cut at the determined arrangement angle.

17 Claims, 15 Drawing Sheets

| | | SPEED DATA (Vx,Vy) |
|---|---|---|
| DURING FEED | | HIGH |
| DURING CUTTING | PAPER | MIDDLE |
| | FELT | LOW |
| | ⋮ | ⋮ |

(56) References Cited

U.S. PATENT DOCUMENTS

| | | | | |
|---|---|---|---|---|
| 2013/0074667 | A1* | 3/2013 | Weber | B25J 9/0051 83/73 |
| 2013/0152755 | A1* | 6/2013 | Hasegawa | B26D 7/015 83/451 |
| 2013/0340892 | A1* | 12/2013 | Parker | G01N 29/045 144/356 |
| 2015/0032249 | A1 | 1/2015 | Okuyama | |
| 2015/0116716 | A1* | 4/2015 | Noguchi | B26D 5/005 356/445 |

FOREIGN PATENT DOCUMENTS

| | | | |
|---|---|---|---|
| JP | 2007-125627 | A | 5/2007 |
| JP | 2013-013976 | A | 1/2013 |
| JP | 2015-024483 | A | 2/2015 |

* cited by examiner

| PATTERN NUMBER n | |
|---|---|
| PATTERN A1 | FEED DATA (F1x0,F1y0) |
| | FIRST COORDINATE DATA (x1,y1)<br>SECOND COORDINATE DATA (x2,y2)<br>THIRD COORDINATE DATA (x3,y3)<br>FOURTH COORDINATE DATA (x4,y4) |
| PATTERN A2 | FEED DATA (F2x0,F2y0) |
| | FIRST COORDINATE DATA (x1,y1)<br>SECOND COORDINATE DATA (x2,y2)<br>THIRD COORDINATE DATA (x3,y3)<br>FOURTH COORDINATE DATA (x4,y4) |
| | FEED DATA (F3x0,F3y0) |
| | |
| PATTERN A80 | FIRST COORDINATE DATA (x1,y1)<br>SECOND COORDINATE DATA (x2,y2)<br>THIRD COORDINATE DATA (x3,y3)<br>FOURTH COORDINATE DATA (x4,y4) |
| | END CODE |

FIG.5

FIG. 7A
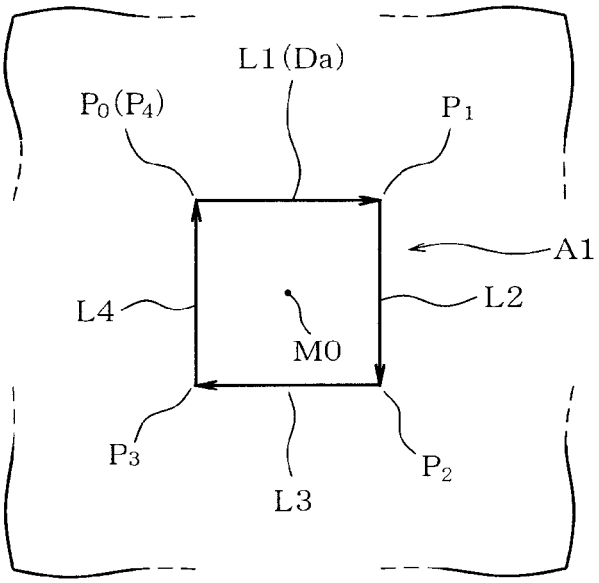
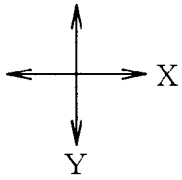
FIG. 7B
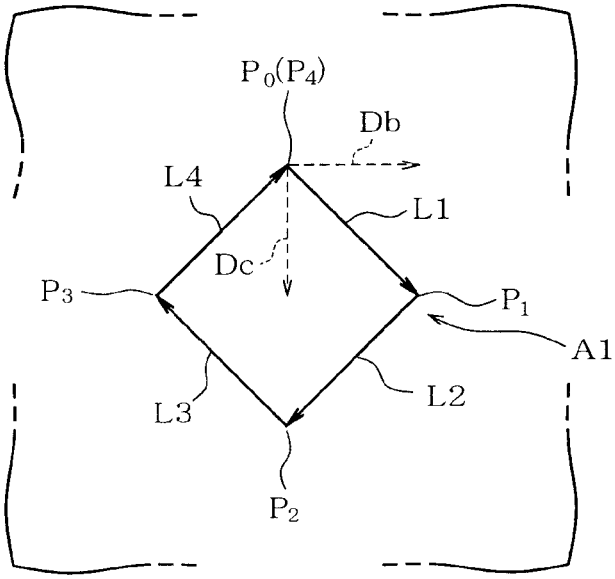

| | | SPEED DATA (Vx,Vy) |
|---|---|---|
| DURING FEED | | HIGH |
| DURING CUTTING | PAPER | MIDDLE |
| | FELT | LOW |
| | ⋮ | ⋮ |

CUTTING APPARATUS AND NON-TRANSITORY COMPUTER-READABLE MEDIUM

CROSS-REFERENCE TO BELATED APPLICATIONS

This application is based upon and claims the benefit or priority from the prior Japanese Patent Application No. 2013-156684 filed on Jul. 29, 2013, the entire contents of which are incorporated herein by reference.

BACKGROUND

1. Technical Field

The present disclosure relates to a cutting apparatus cutting a pattern out of an object and a non-transitory computer-readable medium.

2. Related Art

Cutting apparatuses have been conventionally known which cut a pattern out of an object. One of the cutting apparatuses is configured to perform automatic cutting of a sheet serving as the object, such as paper, based on cutting data on which a pattern is cut. The sheet is attached to a holding sheet having an adhesive layer on a surface. The cutting apparatus then moves the holding sheet in a first direction and a cutting blade in a second direction perpendicular to the first direction, thereby cutting a desired pattern out of the sheet.

One type of cutting apparatus changes existing cutting data to perform cutting, in order to shorten a pattern cutting time. More specifically, when a plurality of patterns having the same configuration is to be cut, the patterns are arranged so as to lie next to each other so that at least parts of cutting lines of the patterns are in touch with each other, and cutting data is generated in which the cutting lines are connected so that the cutting lines of the patterns are connected together or commonalized. The cutting apparatus cuts a plurality of patterns continuously with the result that a cutting time can be shortened as compared with the case where a plurality of patterns are cut in sequence.

SUMMARY

In the above-described cutting apparatus, however, the cutting time length is shortened by arranging a plurality of patterns having the same configuration. Accordingly, the cutting time length cannot be shortened when a single pattern is to be cut.

Therefore, an object of the disclosure is to provide a cutting apparatus which can reduce the cutting time length even when a single pattern is to be cut and a non-transitory computer-readable medium storing a program for the cutting apparatus.

The disclosure provides a cutting apparatus cutting a pattern out of an object, including a moving device configured to move a cutting blade and the object in a first direction relative to each other and in a second direction differing from the first direction, relative to each other, and a control device configured to cause the apparatus to calculate first cutting time lengths required to cut the pattern at a plurality of arrangement angles in a case where the pattern is rotated while an arrangement angle of the pattern relative to the first or second direction is changed by a predetermined first unit angle, to determine one of the arrangement angles, which is shortest with respect to the first cutting time length or not more than a first predetermined threshold, and to control the moving device so that the movement of the cutting blade in the first direction and the movement of the object in the second direction are simultaneously executed, whereby the pattern is cut at the determined arrangement angle.

The disclosure also provides a non-transitory computer-readable medium storing a program for a cutting apparatus including a moving device configured to move a cutting blade and the object in a first direction relative to each other and in a second direction differing from the first direction, relative to each other, and a control device, wherein the program causes the control device to execute instructions which, when executed, cause the apparatus to calculate first cutting time lengths required to cut the pattern at a plurality of arrangement angles in a case where an arrangement angle of the pattern relative to the first or second direction is changed by a predetermined first unit angle, to determine one of the arrangement angles, which is shortest with respect to the first cutting time length or not more than a first predetermined threshold, and to control the moving device so that the movement of the cutting blade in the first direction and the movement of the object in the second direction are simultaneously executed, whereby the pattern is cut at the determined arrangement angle.

BRIEF DESCRIPTION OF THE DRAWINGS

In the accompanying drawings:

FIG. 5 shows data structure of cutting data;

FIGS. 6A and 68 are plan views of a group of square patterns to be cut out of an object, showing the pattern group before and after change in an arrangement angle respectively;

FIGS. 7A and 7B are enlarged views of ones of the patterns as shown in FIGS. 6A and 6B, respectively;

DETAILED DESCRIPTION

First Embodiment

Figure 1:
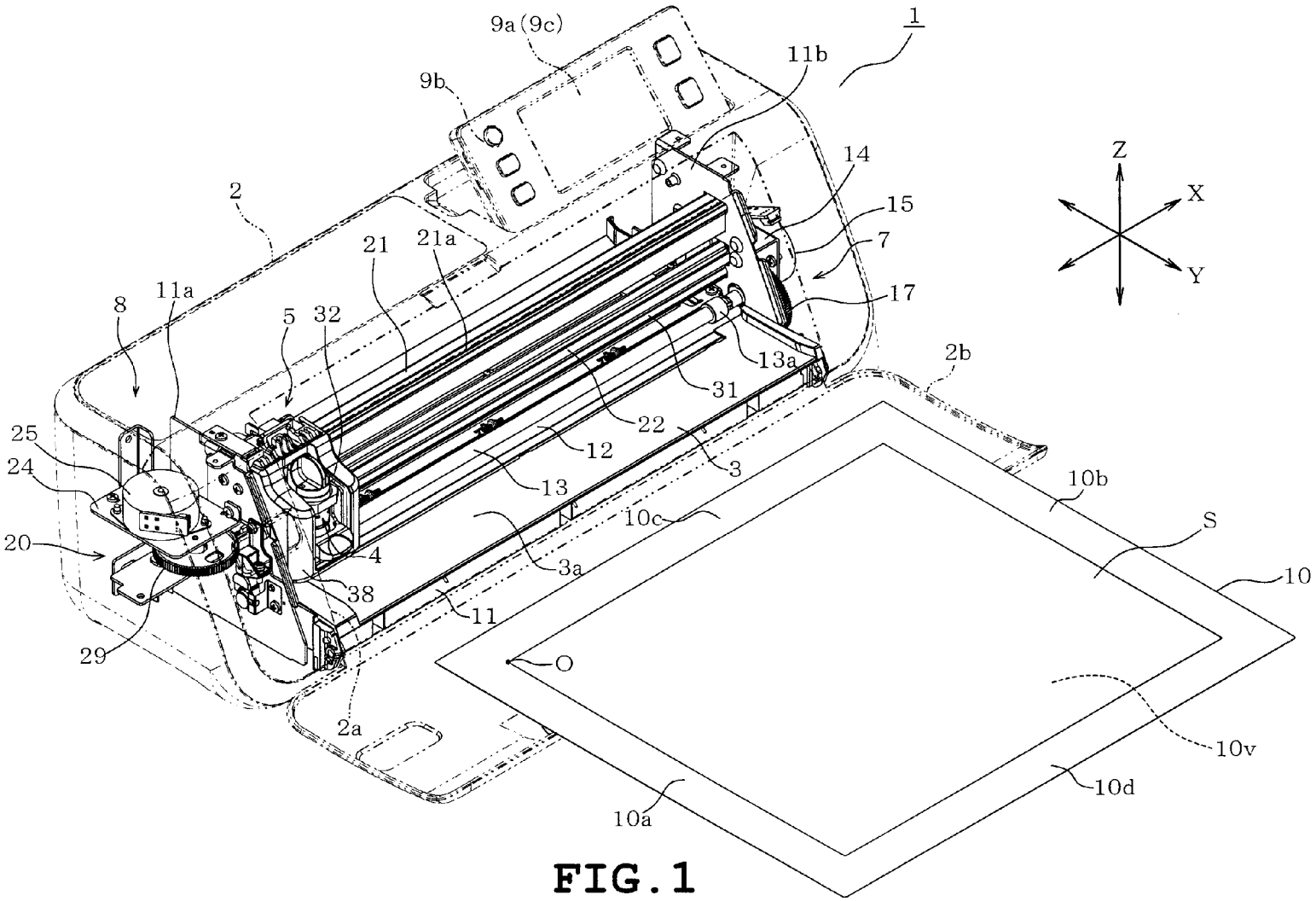
FIG. 1 is a perspective view of a cutting apparatus according to a first embodiment, showing an overall structure thereof.

A first embodiment will be described with reference to FIGS. 1 to 14. Referring to FIG. 1, a cutting apparatus 1 is shown and includes a body cover 2 serving as a housing, a platen 3 provided in the body cover 2 and a cutting head 5 on which a cutter cartridge 4 is to be mounted. The cutting apparatus 1 further includes a holding sheet 10 for holding an object S to be processed.

The body cover 2 is formed into the shape of a horizontally long rectangular box. The body cover 2 has a front formed with a front opening 2*a*. A front cover 2*b* is mounted on the front of the body cover 2 to open and close the front opening 2*a*. The holding sheet 10 holding the object S is set onto the platen 3 while the front opening 2*a* is open, or the cartridge 4 is attached to or detached from a cartridge holder 32.

The cutting apparatus 1 is provided with a transfer mechanism 7 and a head moving mechanism 8. The transfer mechanism 7 transfers the holding sheet 10 set on the platen 3 in a predetermined transfer direction (the Y direction). The head moving mechanism 3 moves the cutting head 5 in a direction intersecting with the transfer direction of the holding sheet 10 (for example, the X direction perpendicular to the transfer direction). In the following description, the direction in which the holding sheet 10 is transferred by the transfer mechanism 7 will be referred to as "front-back direction". That is, the front-back direction is the Y direction and the right-left direction perpendicular to the Y direction is the X direction.

A liquid-crystal color display 9*a* and an operation device 9*b* including various operation switches are mounted on a right upper surface of the body cover 2. The display 9*a* is capable of full color display and is configured to display information about various patterns, messages necessary to the user, and the like. A touch panel 9*c* (see FIG. 4) is placed on a display surf ace side of the display 9*a*. The operation device 9*b* or the touch panel 9*c* is operable for selection of a pattern displayed on the display 9*a*, selection of various processing modes, the setting and input of various parameters, and the like. A pattern designating unit is comprised of the display device 3*a*, the operation device 9*b* and the touch panel 9*c* together with a control circuit 61 which will be described later.

Figure 2:
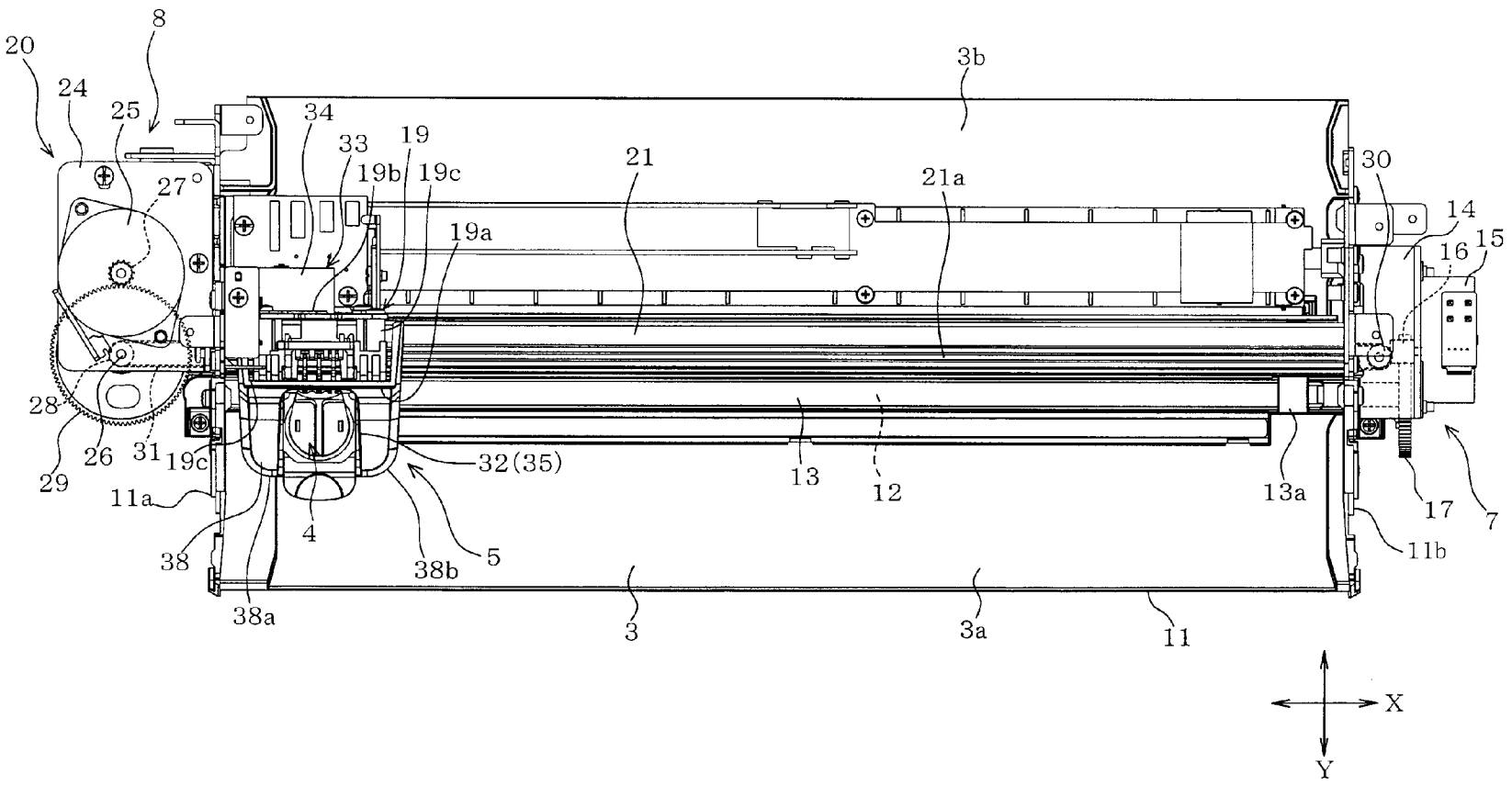
FIG. 2 is a plan view of the cutting apparatus, showing an inner structure thereof.

The platen 3 receives the underside of the holding sheet 10 when the object S is cut. The platen 3 includes a front platen 3*a* and a rear platen 3*b* and has a horizontal upper surface as shown in FIG. 2. The holding sheet 10 holding the object S is transferred while being placed on the platen 3. The holding sheet 10 is made of a synthetic resin material, for example and formed into a rectangular shape. An adhesive layer 10*v* (see FIG. 1) is formed on an upper side of the holding sheet 10. The adhesive layer 10*v* is formed by applying an adhesive agent to an inner region of the holding sheet 10 except for peripheral edges 10*a* to 10*d*. The object S is attached to the adhesive layer 10*v* thereby to be held on the holding sheet 10. The adhesive layer 10*v* has an adhesive force which is set so that the object S is immovably held reliably in the cutting process by the use of a cutter 6 of the cutter cartridge 4 and so that the object S can be easily removed after the cutting. The transfer mechanism 7 and the head moving mechanism 8 are constructed into a moving device 20 which moves the holding sheet 10 holding the object S in the X direction and the cutting head 5 in the Y direction relative to each other.

The transfer mechanism 7 transfers the holding sheet 10 on the upper surface side of the platen 3 freely in the Y direction as the first direction. A frame 11 is enclosed in the body cover 2 as shown in FIGS. 1 and 2. The frame 11 includes right and left side walls 11*b* and 11*a* which are located at right and left sides of the platen 3 so as to face each other, respectively. A driving roller 12 and a pinch roller 13 are mounted on both sidewalls 11*a* and 11*b* so as to be located in a space between the front and rear platens 3*a* and 3*b*. The driving roller 12 and the pinch roller 13 extend in the right-left direction and lined in the up-down direction. The pinch roller 13 is located above the driving roller 12.

The driving roller 12 has an upper end which is substantially level with the upper surface of the platen 3 and right and left ends mounted on the right and left sidewalls 11*b* and 11*a* respectively so that the driving roller 12 is rotatable. The right end of the driving roller 12 extends rightward through the right sidewall 11*b* as shown in FIG. 2. A driven gear 17 having a large diameter is secured to the right end of the driving roller 12. Amounting frame 14 is fixed to an outer surface of the right sidewall 11*b*. A Y-axis motor 15 comprised of a stepping motor, for example is mounted on the mounting frame 14. The Y-axis motor 15 has an output shaft to which is fixed a driving gear 16 having a small diameter and is to be brought into mesh engagement with the driven gear 17.

The pinch roller 13 has right and left ends mounted on the right and left sidewalls 11*b* and 11*a* respectively so that the pinch roller 13 is rotatable and slightly displaceable in the up-down direction. Two springs (not shown) are mounted on outer surfaces of the right and left sidewalls 11*b* and 11*a* to normally bias the right and left ends of the pinch roller 13 downward. Accordingly, the pinch roller 13 is normally biased downward (to the driving roller 12 side) by the springs. Two rollers 13*a* having slightly larger diameters are mounted on the pinch roller 13 so as to be located near both ends thereof, respectively. Only the right roller 13*a* is shown in FIGS. 1 and 2.

The holding sheet 10 has right and left edges 10*b* and 10*a* held between the driving roller 12 and the rollers 13*a* of the pinch roller 13. Upon normal or reverse rotation of the Y-axis motor 15, the rotation is transmitted via the gears 16 and 17 to the driving roller 12, whereby the holding sheet 10 is transferred rearward or forward. The transfer mechanism 7 is thus comprised of the driving roller 12, the pinch roller 13, the Y-axis motor 15 and the gears 16 and 17 serving as a reduction mechanism.

The head moving mechanism 8 serves to move a carriage 19 of the cutting head 5 freely in the X direction as the second direction. A pair of guide rails 21 and 22 are fixed to the right and left sidewalls 11*b* and 11*a* so as to be located slightly rear above the pinch roller 13, as shown in FIGS. 1 and 2. The guide rails 21 and 22 extend in the right-left direction substantially in parallel to the pinch roller 13. Guide grooves are formed in an upper surface of the guide rail 21 and an underside of the guide rail 22 so as to extend between the right and left ends although only the guide groove 21*a* of the upper surface is shown.

Furthermore, the carriage 19 has a pair of protrusions engaging the guide grooves 21*a* respectively although the guide grooves are not shown. The protrusions are formed on the upper and lower sides so as to hold the guide grooves 21*a* therebetween in the up-down direction. Thus, the carriage 19 is supported by the engagement of the protrusions and the guide grooves 21*a* so as to be slidable on the guide rails 21 and 22 in the right-left direction.

A horizontal mounting frame 24 is fixed to the outer surface of the left sidewall 11*a* so as to be located near the rear of the left sidewall 11*a* at the outer surface side, as shown in FIGS. 1 and 2. An X-axis motor 25 is mounted on the mounting frame 24 to a downward direction. Furthermore, a vertically extending pulley shaft 26 (see FIG. 2) is mounted on the mounting frame 24 so as to be located in front of the X-axis motor 25. The X-axis motor 25 is comprised of a stepping motor, for example and has an output shaft to which a driving gear 27 having a small diameter is fixed. A timing pulley 28 and a driven gear 29 having a large diameter are rotatably mounted on the pulley shaft 26. The driven gear 29 is brought into mesh engagement with the driving gear 27. The timing pulley 28 and the driven gear 29 are configured to be rotated together.

On the other hand, a timing pulley 30 is mounted on the right mounting frame 14 so as to be rotatable about an axis extending in the up-down direction. An endless timing belt 31 horizontally extends between the timing pulleys 30 and 28 in the right-left direction. The timing belt 31 has a midway part joined to a mounting part (not shown) of the carriage 19.

Upon normal or reverse rotation of the X-axis motor 25, the rotation is transmitted via the gears 27 and 29 and the timing pulley 23 to the timing belt 31, whereby the cutting head 5 is moved leftward or rightward. Thus, the carriage 19 is moved in the right-left direction perpendicular to the direction in which the object S is transferred. The head moving mechanism 8 thus includes the guide rails 21 and 22, the X-axis motor 25, the gears 27 and 29 serving as a reduction mechanism, the timing pulleys 23 and 30, the timing belt 31 and the like.

Figure 3A:
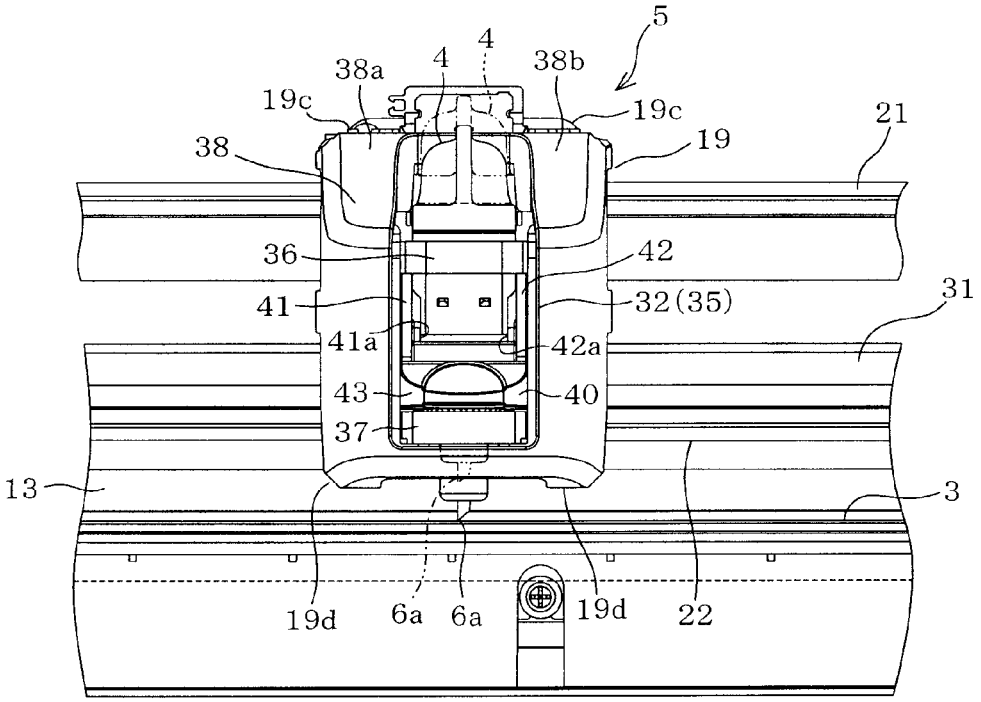
FIGS. 3A and 3B are front views showing a cutting head and its vicinity, and a cutter cartridge respectively.

The cutting head 5 includes an up-down drive mechanism 33 and a cartridge holder 32 disposed in the rear and in front of the carriage 19 as shown in FIG. 2. The up-down drive mechanism 33 is configured to drive the cartridge holder 32 in the up-down direction (the 2 direction) together with the cartridge 4. The carriage 19 includes front and rear walls 19*a* and 19*b* and upper and lower arms 19*c* and 13*d* connecting the walls 18*a* and 19*b*, as shown in FIGS. 2 and 3A. Thus, the carriage 19 is formed to surround the front and rear sides and upper and lower sides of the guide rails 21 and 22. A Z-axis motor 34 (see FIG. 2) is mounted on the rear wall 19*b* of the carriage 19 so that an axis thereof is directed frontward. The Z-axis motor 34 is comprised of a stepping motor, for example. A transmission mechanism (not shown) is provided between the Z-axis motor 34 and the cartridge holder 32. The transmission mechanism reduces a rotational speed of the Z-axis motor 34 and converts rotation of the Z-axis motor 34 to up-down movement of the cartridge holder 32, transmitting the up-down movement. The up-down drive mechanism 33 thus includes the transmitting mechanism and the Z-axis motor 34.

Figure 3B:
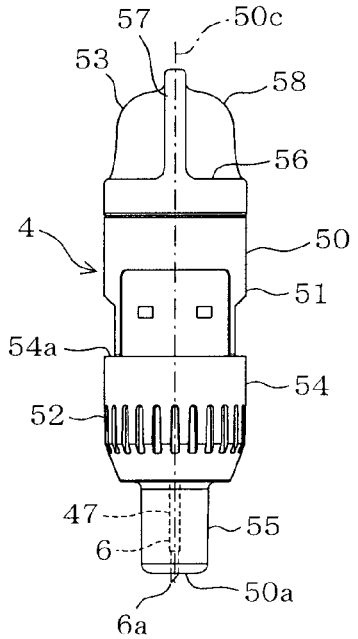

Upon normal or reverse rotation of the Z-axis motor 34, the rotation is converted via the transmission mechanism to the up-down movement, whereby the cartridge holder 32 is moved upward or downward together with the cutter cartridge 4. As a result, the cartridge holder 32 is moved together with the cutter cartridge 4 between a lowered position and a raised position (see two-dot chain line in FIG. 3A). When the cutter cartridge 4 of the cartridge holder 32 is located at the lowered position, cutting is carried out by a blade edge 6*a* of a cutter 6 as shown in FIG. 3B. When the cutter cartridge 4 of the cartridge holder 32 is located at the raised position, the blade edge 6*a* of the cutter 6 is spaced away from the object S by a predetermined distance.

When the cutter cartridge 4*c* is attached to the cartridge holder 32 and is located at the lowered position, the blade edge 6*a* penetrates the object S. Pressure of the blade edge 6*a* in this state will be set to be suitable for the cutting based on an amount of rotation of the Z-axis motor 34. The pressure will hereinafter be referred to as "cutter pressure."

The cartridge holder 32 includes a holder frame 35 driven up and down by the up-down drive mechanism 33 and upper and lower holders 36 and 37 both fixed to the holder frame 35 as shown in FIGS. 2 and 3A. More specifically, a cover member 38 is mounted on the front wall 19*a* of the carriage 19 to cover right and left sides of the front wall 19*a* from front. The holder frame 35 serving as a movable part is disposed between a left projection 38*a* and a right projection 38*b* of the cover member 33. The holder frame 35 is formed to have a top, underside and front all of which are open as shown in FIG. 2. The upper and lower holders 36 and 37 are attached so that the cartridge 4 is inserted through the both holders 36 and 37 from above. The upper and lower holders 36 and 37 are each formed into a frame shape such that the holders 36 and 37 are housed in the holder frame 35.

The holder frame 35 is provided with a lever member 40 located between the upper and lower holders 36 and 37 as shown in FIG. 3A. The lever member 40 has a pair of right and left arms 42 and 41 and an operating portion 43 which is provided to connect between distal end sides of the arms 41 and 42. The lever member 40 is swingably mounted on the holder frame 35 while having a proximal end located at the side of upper ends of the arms 41 and 42. The arms 41 and 42 include inner surface sides provided with small columnar engagement portions 41*a* and 42*a* respectively. The engagement portions 41*a* and 42*a* are formed to be engageable with engaged portions 54*a* of the cutter cartridge 4 respectively.

As a result, the lever member 40 is swung about the proximal ends oh the arras 41 and 42 so as to be switchable between a fixed position shown in FIG. 3A and an open position at which the operating portion 43 is pulled frontward so that the lever member 40 is swung. As shown in FIG. 3A, the engagement portions 41*a* and 42*a* engage engaged portions 54*a* respectively when the lever member 40 is located at the fixed position. As the result of the engagement, the cutter cartridge 4 is fixed to the lower holder 37 (the cartridge holder 32). On the other hand, when operated so as to be pulled frontward, the lever member 40 is swung from the fixed position to the open position. With this swing, the engagement portions 41*a* and 42*a* depart from the respective engaged portions 54*a*, whereby the lever member 40 is released from the fixed state. Thus, the cutter cartridge 4 can be detachably attached to the cartridge holder 32 easily and reliably by operating the lever member 40.

A plurality of cutter cartridges 4 detachably attached to the cartridge holder 32 is prepared for the cutting apparatus 1 of the embodiment. The cutter 6 is replaceable together with the cartridge 4. The cutter cartridge 4 will now be described with reference to FIG. 3B. The cutter cartridge 4 has a case 50 including a case body 51, a cap 52 and a knob 53. The cap 52 and the knob 53 are mounted on one end and the other end of the case body 51 respectively. The case body 51 is formed into a cylindrical shape and extends in the up-down direction. The cap 52 includes a larger-diameter portion 54 and a smaller-diameter portion 55. The larger-diameter portion 54 is fitted with a lower end of the case body 51. The larger-diameter portion 54 has an upper end serving as an engaged portion 54*a* which abuts on the engagement portions 41*a* and 42*a* of the lever member 40. The larger-diameter portion 54 has a lower end which is fitted with the lower holder 37 of the cartridge holder 32. The cap 52 has an underside 50*a* formed into a flat shape. The underside 50*a* has a through hole (not shown) through which the blade edge 6*a* of the cutter 6 is inserted. The knob 53 has a cover plate 56, a knob plate 57 and a rear plate 58 all of which are formed integrally therewith. The cover plate 56 is fixed to an upper part of the case body 51. The knob plate 57 and the rear plate 58 are provided on an upper part of the cover plate 56. The knob plate 57 is mounted on a central part of the cover plate 56 in the right-left direction so as to be directed vertically.

The cutter cartridge 4 includes the cutter 6 having a proximal end serving as a cutter shaft 41 and a distal end (a lower end) serving as the blade edge 6*a*, both of which are formed integrally with the cutter 6. The cutter shaft 47 is formed into a round bar shape and is housed in the case 50. The blade of the cutter 6 is generally formed into a V-shape tilted relative to the object S although not shown in detail in the drawings. Furthermore, bearings (not shown) are provided in the case body 51 to support the cutter shaft 47 so that the cutter shaft 47 is rotatable about a central axis 50*c* thereof. The blade edge 6*a* protrudes from the underside 50*a* of the cap 52.

In cutting the object S, a control circuit 61 causes the up-down drive mechanism 33 to move the cutter cartridge 4 attached to the cartridge holder 32 to the lowered position and set the cutter cartridge 4 to the above-described cutter pressure. In this case, the blade edge 6*a* penetrates through the object S on the holding sheet 10 and further slightly into the holding sheet 10. In this state, the holding sheet 10 and the cutter cartridge 4 (the cutter 6) are moved in the X and Y directions relative to each other by the transfer mechanism 7 and the head moving mechanism 8 respectively, so that the cutting of the object S is executed. An X-Y coordinate system is set in the cutting apparatus 1 with, for example, a left corner of adhesive layer 10*v* serving as the origin O of the holding sheet 10 as shown in FIG. 1. The holding sheet 10 (the object S) and the cutting head 5 (the cutter 6) are moved relative to each other based on the X-Y coordinate system.

Figure 4:
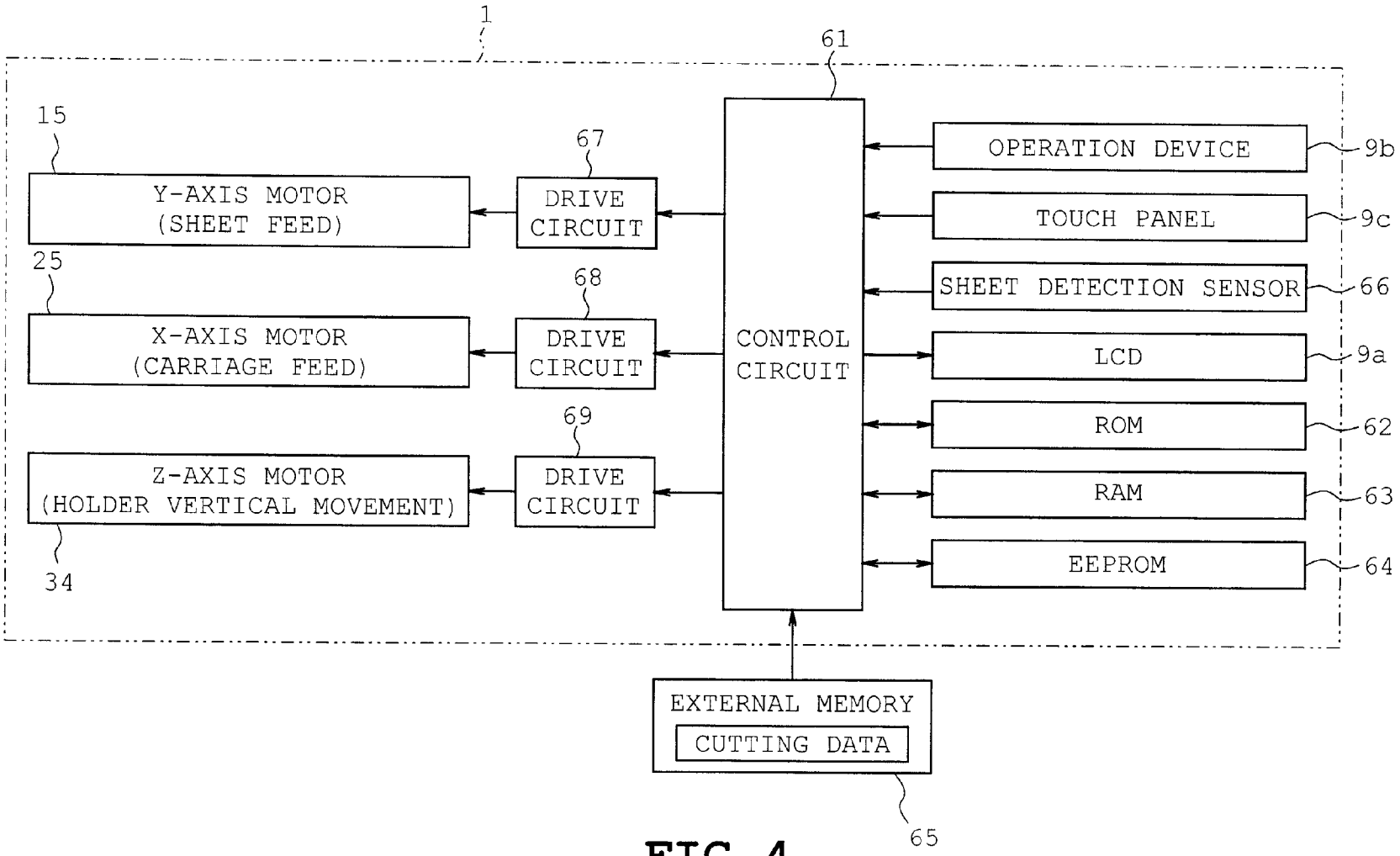
FIG. 4 is a block diagram showing an electrical arrangement of the cutting apparatus.

The configuration of the control of the cutting apparatus 1 will be described with reference to FIG. 4. The control circuit 61 controlling the whole cutting apparatus 1 is mainly composed of a computer (CPU). The control circuit 61 is connected to a ROM 62, a RAM 63, an EEPROM 64 and an external memory 65. The ROM 62 stores a cutting control program for controlling a cutting operation, a display control program for controlling display by the display 9*a*, a processing program which will be described later, and the like. Each of the ROM 62 and the external memory 65 is configured as a storage unit for storing cutting data for cutting a plurality of types of patterns.

Signals generated by a sheet detection sensor 66 and various operation switches are supplied to the control circuit 61. The control circuit 61 is further connected to the display 2*a* and the touch panel 9*c*. While viewing the contents displayed on the display 9*a*, the user operates one or more operation switches of the operation device 9*b* or the touch panel 9*c*, so that the user can select a desired pattern or set various processing modes and parameters. The control circuit 61 is still further connected to drive circuits 67, 68 and 63 driving the Y-axis motor 15, the X-axis motor 25, the Z-axis motor 34 respectively. The control circuit 61 controls the Y-axis motor 15, the X-axis motor 25, the S-axis motor 34 and the like based on the cutting data, thereby causing the cutting apparatus 1 to execute a cutting operation for the object S placed on the holding sheet 10.

The cutting data will now be described with an example in which a plurality of patterns is cut out of the object S held on the holding sheet 10. As exemplified in FIG. 6A, patterns A1 to A80 each of which is formed into the shape of a square are to be cut. The patterns A1 to S80 are arranged in ten rows and eight columns.

Full data (cutting data) in this case includes "pattern number n" indicative of information about a total number of patterns, "pattern A1" to "pattern A80" indicative of cutting line data, display data and the like, as shown in FIG. 5. The total number of patterns or "pattern number n" is 80. Cutting line data is data of coordinate values indicative of X-Y coordinates of apexes of a cutting line composed of a plurality of line segments and is defined by the X-Y coordinate system of the cutting apparatus 1.

More specifically, as shown in an enlarged form in FIG. 7A, the cutting line of pattern A1 includes four line segments L1 to L4 and is formed into a closed square having a cutting start point $P_0$ and a cutting end point $P_4$ corresponding with each other. The cutting line data of pattern A1 includes feed data (Flx0, Fly0), first coordinate data (x1, y1), second coordinate data (x2, y2), third coordinate data (x3, y3) and fourth coordinate data (x4, y4) corresponding to cutting start point $P_0$, apex $P_1$, apex $P_2$, apex $P_3$ and cutting end point $P_4$ respectively. The feed data is provided to move the cutter 6 to cutting start point $P_0$ in starting the cutting of pattern A1. In other words, the cutting head 5 is moved to the cutting start point $P_0$ at the time of feed without cutting and the cutter 6 is moved up and down, based on the feed data.

The other patterns A2 to A80 are the same square as the pattern A1. Each of the patterns A2 to A80 also includes line segments L1 to L4 as the pattern A1. Coordinate values (first coordinate data to fourth coordinate data) of patterns A1 to A80 are set so that the patterns A1 to A80 are formed to be spaced from one another. An end code is suffixed to the full data.

The control circuit 61 is configured as a cutting control unit which causes the cutting apparatus 1 to execute the cutting of pattern A1 to pattern A80 in sequence, based on the full data. More specifically, the cutter 6 is moved to the X-Y coordinates of cutting start point $P_0$ by the transfer mechanism 7 and the head moving mechanism 8. The blade edge 6*a* of the cutter 6 is then caused to penetrate through the cutting start point $P_0$ of the object S by the up-down drive mechanism 33. The blade edge 6*a* is then moved relatively toward the coordinates of the end point PI of the line segment L1 by the transfer mechanism 7 and the head moving mechanism 8, whereby the object S is cut along the line segment L1. Regarding next line segment L2, cutting is executed with the end point P1 of the previous line segment L1 serving as a start point in the same manner as the line segment L1. Regarding line segments L2 to L4, the cutter 6 is relatively moved so that the pattern A1, namely, the cutting line of "square" is cut.

Regarding the other patterns A2 to A80, too, the cutting line of pattern A2, the cutting line of pattern A3, . . . and the cutting line of pattern A80 are cut in this sequence based on the cutting line data in the same manner as described above. In this case, the blade edge 6*a* of the cutter 6 is spaced from the object S by the up-down drive mechanism 33 to be moved to a position corresponding to a next cutting start point $P_0$ every time the cutting line of each of the patterns A1 to A79 is cut, based on the initial "feed data" of the cutting line data of each of the patterns A2 to A80. When the cutting line of pattern A80 has been cut, the blade edge 6*a* of the cutter 6, which is spaced from the object S, is moved to the origin O which is a stand-by position of the carriage 19, based on the end code.

When the number of patterns to be cut is large as described above, it takes a considerable amount of time to cut all the patterns. Further, when a single pattern having a relatively longer cutting line is to be cut, a certain amount of time is required. In view of these circumstances, new cutting data capable of reducing a cutting time length is generated based on the above-described existing cutting data (full data) in the embodiment.

More specifically, the cutting apparatus 1 forms cutting lines having respective arrangement angles of the patterns A1 to A80 changed by the software configuration (execution of a processing program). An arrangement angle of a pattern denotes a rotation angle in the case where the pattern is rotated about a predetermined rotation center within an X-Y plane parallel to the X direction and the Y direction, for example. More specifically, the arrangement angle of the pattern A1 relative to the X direction (or the Y direction) is determined by the control circuit 61 to be an angle at which a cutting time length (a first cutting time length) becomes shortest when the pattern A1 is rotated about a center point $M_0$ (see FIG. 7A) by a first unit angle θ1. This processing will be described in detail later. The arrangement angle of the pattern A1 is determined to be 45° at which the line segments L1 to L4 of the pattern A1 are tilted relative to the X direction and the Y direction (see FIG. 7B). Cutting line data of the patterns A1 to A80 is converted based on the determined arrangement angle.

A cutting time length of a pattern is calculated from distances of line segments composing the a cutting line, a moving speed Vx of the carriage 19 of the cutting head 5 and a moving speed Vy of the object S. The moving speed Vx in the X direction and. the moving speed Vy in the Y direction are corrected according to the conditions in the cutting. More specifically, as exemplified in FIG. 8, speed data Vx for the X direction and speed data Vy for the Y direction are set at high speed in the feeding. The speed data Vx and Vy are set at middle speed in the cutting when the object S is paper. The speed data Vx and Vy are set at low speed in the cutting when the object S is felt cloth. Data of these conditions is stored in the ROM 62 in the form of a correcting data table. The speed data Vx and Vy are set to be optimum cutting conditions according to material properties of the object S.

The following will describe the relationship between an arrangement angle of a pattern and a cutting time length. Symbol "Da" designates a moving distance of the blade edge 6*a* in the X direction in the cutting of the line segment L1 in the case of the pattern A1 having an initial value of arrangement angle set at 0°, as shown in FIG. 7A. On the other hand, symbol "Db" designates a moving distance of the blade edge 6*a* in the X direction in the cutting of the line segment L1 in the case of the pattern A1 with an arrangement angle being set at 45° as shown in FIG. 7B. Symbol "Dc" designates a moving distance of the object S in the Y direction. In this case, a cutting time length of the line segment L1 depends upon whichever is longer of the moving distances in the X direction and the Y direction when the blade edge 6*a* is moved relative to the object S simultaneously in the X and Y directions by the transfer mechanism 7 and the head moving mechanism 8. In this regard, the moving distance Db in the X direction is equal to the moving distance Dc in the Y direction in the pattern A1 as shown in FIG. 7B. Accordingly, the cutting time length of the line segment L1 can be said to depend upon the moving distance Db in the X direction. The moving distance Da in the X direction at the arrangement angle as shown in FIG. 7A is equal to the length of the line segment L1. On the other hand, the moving distance Db in the X direction at the arrangement angle of 45° as shown in FIG. 7B is obtained by multiplying the length of line segment L1 by cosine 45° (=about 0.7). In other words, the moving distance of the blade edge 6*a* is shortened into the value of 0.7 times when the arrangement angle of the pattern A1 is changed from 0° to 45°. Thus, the relative moving distance of the blade edge 6*a* in the X or Y direction is shortened by the arrangement angle of the pattern with the result that the cutting time length is reduced accordingly. The cutting time length is calculated by the control circuit 61 based on the moving distance Da, Db or Dc and the speed data Vx or Vy.

A concrete processing procedure will be described regarding the above-described generation of new cutting data (full data), with reference to FIGS. 10 to 14. FIGS. 10 to 13 are flowcharts showing a flow of the processing program executed by the control circuit 61. Steps S1 and S2 in the flowchart of FIG. 10 will be described together with acts of the user, for the sake of expedience.

Firstly, the user sets the holding sheet 10 with the object S being attached thereto onto the platen 3 of the cutting apparatus 1 (step S1). Assume now that the object S is a sheet of paper. When a sheet detection sensor 66 detects a distal end of the holding sheet 10, the control circuit 61 sets a left corner of the adhesive layer 10*v* of the holding sheet 10 to the origin O.

The user then causes the display 9*a* to display a pattern selection screen (not shown), selecting a desired pattern by a touch operation to the touch panel 9*c* (step S2). The control circuit 61 reads cutting data (full data as shown in FIG. 5, for example) of the pattern designated by the selection of the user, from cutting data stored in, for example, an external memory 65, causing a memory of the RAM 63 to store the read cutting data. Further, the user causes the display 9*a* to display a setting screen (not shown) and operates the touch panel 9*c* to set to "paper" the type of the object S set at step S1 (step S2). The setting screen displays selection items including "a time reduction mode" to reduce a cutting time length and "a normal mode." When the time length reduction mode is selected by the touch operation to the touch panel 9*c* (YES at step S3), the control circuit 61 executes a cutting time length reducing process (step S4). On the other hand, when the normal mode is selected (NO at step S3), the control circuit 61 proceeds to step S6 without execution of the cutting time reducing process.

Figure 11:
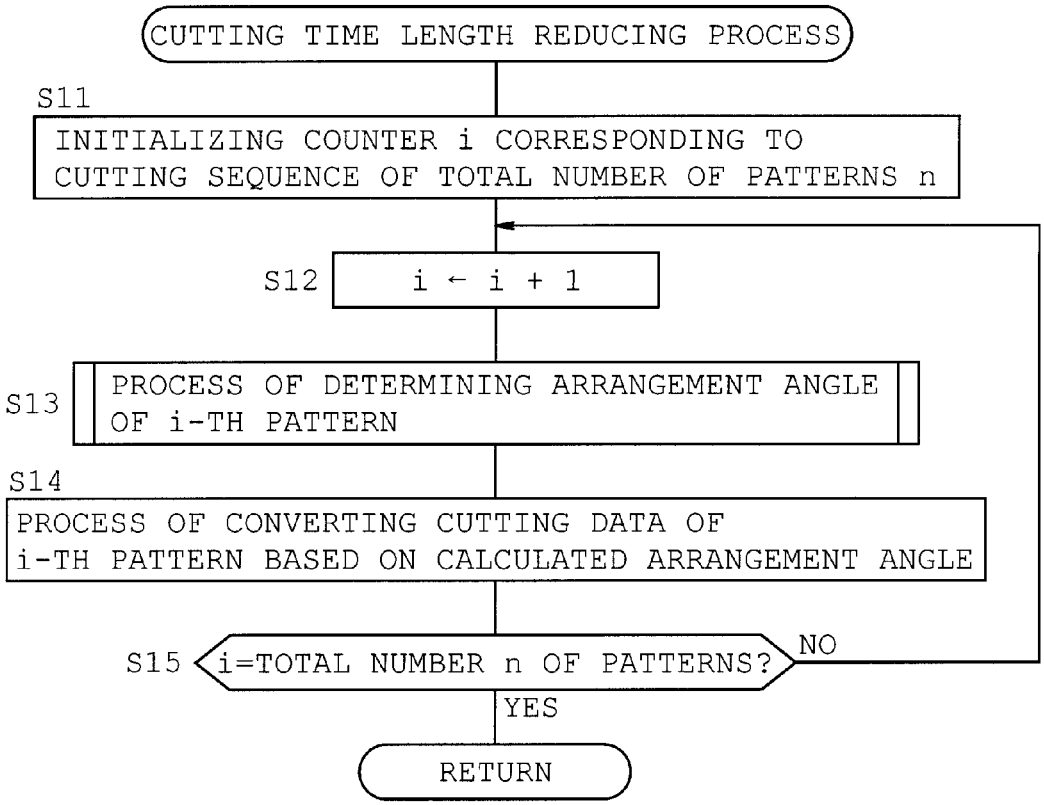
FIG. 11 is a flowchart of a cutting time reducing process.

In the cutting time length reducing process as shown in FIG. 11, the control circuit 81 resets a counter i to 0 thereby to initialize the counter i (step S11). The counter i corresponds to a cutting sequence of the patterns A1 to A80. The control circuit 61 subsequently increments the counter i by 1 (step S12) and executes a process of obtaining an arrangement angle to render the cutting time length shortest with respect to the first pattern A1 in the cutting sequence (step S13; see FIG. 12).

In this case, the control circuit 61 resets a shortest cutting time length Tm and an arrangement angle θm of the pattern A1 and an angle counter θc to 0 for initialization. The angle counter θc represents a current arrangement angle of the pattern A1. Further, the arrangement angle (the state as shown in FIG. 7A) of the pattern A1 in the existing cutting data is set to 0. A cutting time length Tc of the pattern A1 in this case is calculated in the following manner (step S22; see FIG. 13). More specifically, the control circuit 61 initializes the cutting time length Tc to 0 and obtains coordinate data (origin O) at a standby position of the carriage 19, that is, at the current coordinate position and coordinate data of the cutting start point $P_0$ of the pattern A1, that is, a destination, at step S31 in FIG. 13. Based on the obtained coordinate data, the control circuit 61 obtains lengths D or distances from the origin O to the cutting start point $P_0$ of the pattern A1 in the X and Y directions (step S32). In this case, the coordinate data of the destination is feed data (YES at step S31; see Flx0 and Fly0 in FIG. 5). The control circuit 61 then calculates a transit time to reach the cutting start point $P_0$, based on the relative movement conditions of the cutter 6 in the feeding and the lengths in the X and Y directions obtained at step S32 (steps S35 and S36).

Figure 6A:
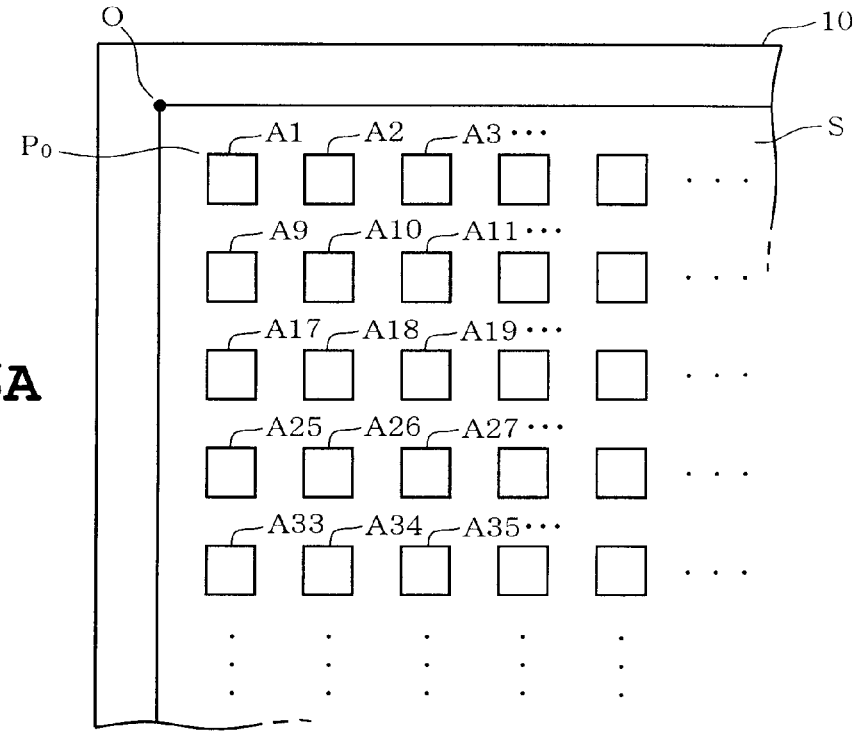
Figures 8, 9:
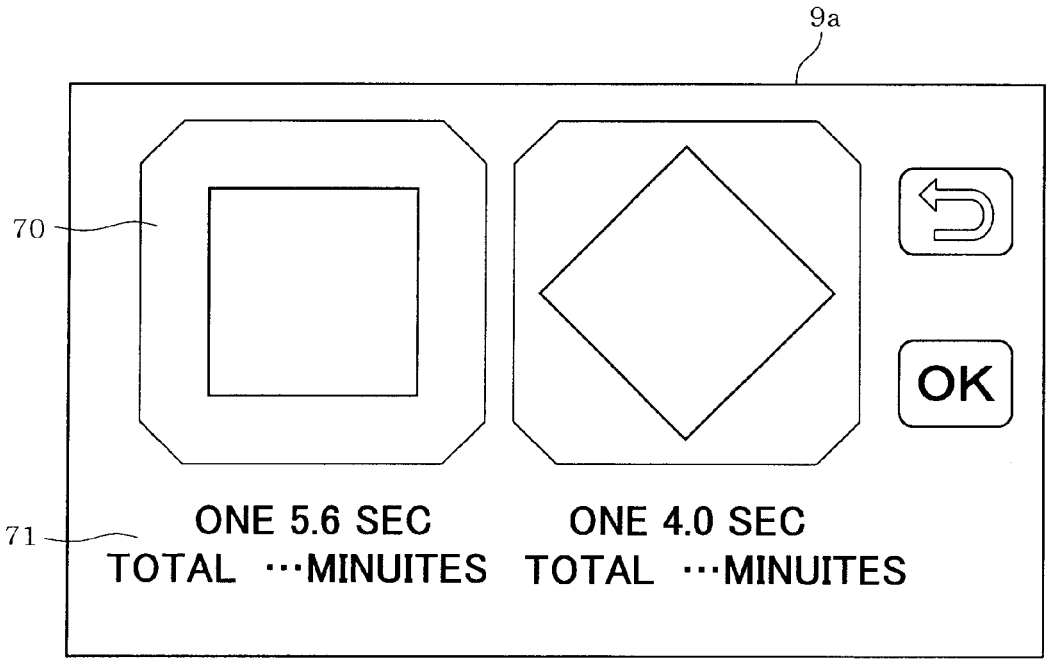
FIG. 8 shows types of objects correlated to set speeds of a moving device.
FIG. 9 shows a screen displaying the pattern before change and the pattern after change together with cutting time lengths.
Figure 10:
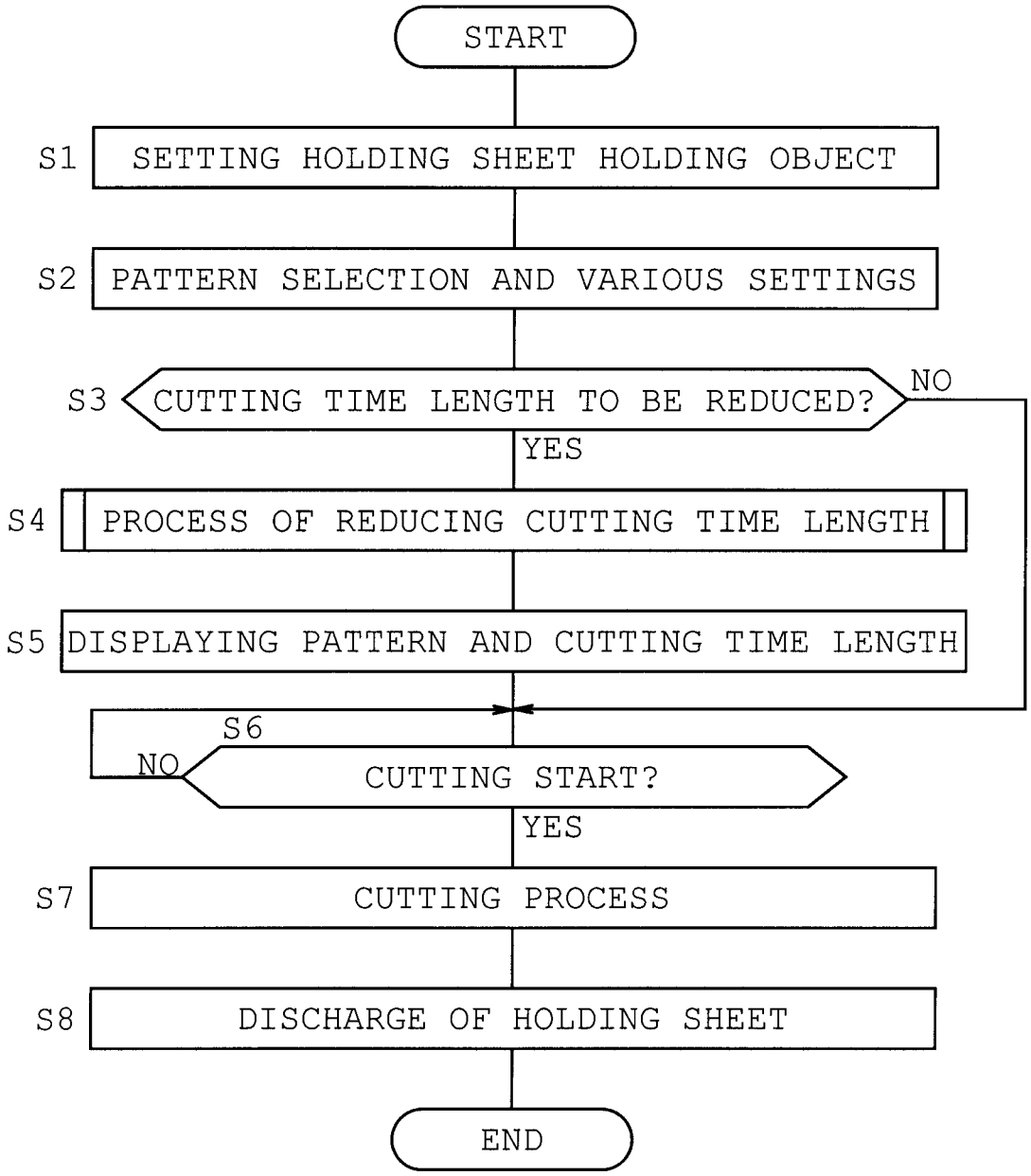
FIG. 10 is a flowchart of main processing, showing an overall processing flow.

More specifically, the control circuit 61 calculates a transit time in the case where the cutter 6 is relatively moved simultaneously in the X and Y directions to the cutting start point $P_0$, based on the lengths from the origin O as shown in FIG. 6A to the cutting start point $P_0$ of the pattern A1 in the X and Y directions and the speed data Vx and Vy in the feeding as shown in FIG. 8. Further, since the blade edge 6*a* of the cutter 6 is located at the raised position spaced from the object S in the feeding, the control device 61 adds a moving time of the cutter 6 in the up-down direction to a moving time in the X and Y directions, storing the addition in the RAM 63. (step S37). After having calculated the moving time to the cutting start point Ft, the control circuit 61 obtains coordinate data of the apex Id as a next destination (NO at steps S38 and S39), obtaining the line segment L1 connecting between the apexes $P_0$ and $P_1$ (step S32).

Since the coordinate data of the apex $P_1$ is not feed data (NO at step S33) in this case, the control circuit 61 obtains speed data Vx and Vy in the cutting, corresponding to the type (paper in this case) of the object S set at step S2 (step S34). Further, as shown in FIG. 7A, the cutting data indicates that the initial value of the arrangement angle of the pattern A1 is 0° (angle counter θc=0) and the line segment L1 from the cutting start point $P_0$ to the apex $P_1$ is parallel to the X direction. The control circuit 61 then calculates a cutting time length Tc of the line segment L1, based on the length of the line segment L1 and the speed data Vx (steps S36 and S37). The control circuit 61 subsequently obtains coordinate data of the apex $P_2$ which is a next destination (step S38 and NO at step S39) and further obtains a cutting time length of the line segment L2 connecting between the apexes $P_1$ and $P_2$ (step S32).

In this case, the control circuit 61 calculates a cutting time length of the line segment L2 based on the length of the line segment L2 and the speed data Vy in the same manner as the line segment L1 (steps S34 and S35). The control circuit 61 thus executes steps S32 to S34 and S36 to S39 to further accumulate cutting time lengths Tc of the remaining line segments L3 and L4, thereby calculating the cutting time lengths Tc of the line segments L1 to L4 of the pattern A1. The cutting time length Tc of the pattern A1 is stored in the RAM 63 together with the transit time to the cutting start point $P_0$ so that a total cutting time length can be calculated. The total cutting time length is an addition of the cutting time length Tc of the pattern A1 and the cutting time lengths of the remaining patterns A2 to A80. Subsequently, the control circuit 61 reads feed data of the pattern A2 at step S38. When determining that the calculation of the cutting time length Tc of the pattern A1 has been completed (YES at step S39). the control circuit 61 returns to step S23 in FIG. 12. Since the shortest cutting time length Tm is currently an initial value of 0 (YES at step S23), the shortest cutting time length Tm is updated by the current value, 0, of the angle counter θc (step S24).

Figure 14:
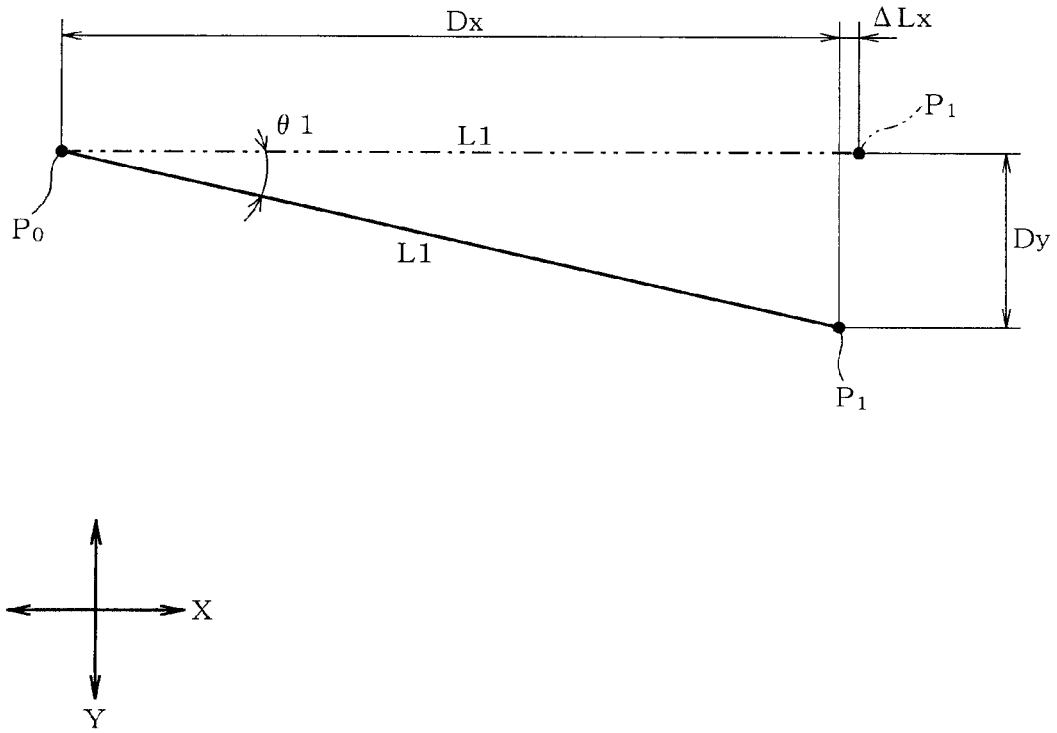
FIG. 14 is a diagrammatic view for explaining a first unit angle.

In the embodiment, the control circuit 61 calculates the cutting time lengths Tc of the pattern at arrangement angles in the case where the pattern A1 is rotated about the center point $M_0$ while an arrangement angle of the pattern A1 is changed by the first unit angle θ1 (1°, for example) at a plurality of times (step S25, NO at step S26, and steps S22 to S24). More specifically, the angle counter θc is set to 1 indicative of the first unit angle θ1 (step S25) so that the arrangement angle of the pattern A1 is changed from 0° as shown in FIG. 7 to 1°. Regarding the cutting time length Tc of the pattern A1, the line segments L1 and L3 are tilted by 1° relative to the X direction and the line segments L2 and L4 are tilted by 1° relative to the Y direction. Accordingly, the cutting time length Tc is rendered slightly shorter as compared with the cutting time length Tc in the case where the angle counter θc is 0 (step S22). Regarding processing at step S22 in this case, differences from the processing in the case where the angle counter θc is set at 0 will be described with reference to the schematic view of FIG. 14. In FIG. 14, the two-dot chain line shows the line segment L1 in a first case where the angle counter θc is set at 0, and the solid line shows the line segment L1 in a second case where the angle counter θc is set at 1. The cutting start point $P_0$ of the first case is caused to correspond with the cutting start point $P_0$ of the second case so that the first unit angle θ1 is exaggerated, for the sake of expedience.

When calculating a cutting time length with respect to the line segment L1 of solid line (step S32 in FIG. 13), the control circuit 61 calculates a longer one of X-direction length Dx and Y-direction length Dy, based on coordinate data of both ends P0 and P1. In this case, since the X-direction length Dx is longer than the Y-direction length Dy, the X-direction length is calculated. The x-direction length Dx is obtained by an equation, Dx=L1×cos θ1. Thus, the X-direction length is reduced by ΔLx=L1−Dx when the line segment L1 of solid line is tilted by old. As a result, the cutting time length Tc required to cut the line segment L1 of solid line is reduced by the length ΔLx (steps S36 and S37). More specifically, the relative movement of the cutter 6 by the length Dx in the X direction and the relative movement of the cutter 6 by the length Dy in the Y direction are carried out simultaneously in the cutting of the line segment L1 of solid line. However, since Dx>Dy, the cutting time length Tc is reduced by the length ΔLx. Further, the reduced cutting time length Tc is calculated in the same manner as the line segment L1 regarding each one of the other line segments L2 to L4 of the pattern A1.

Figure 12:
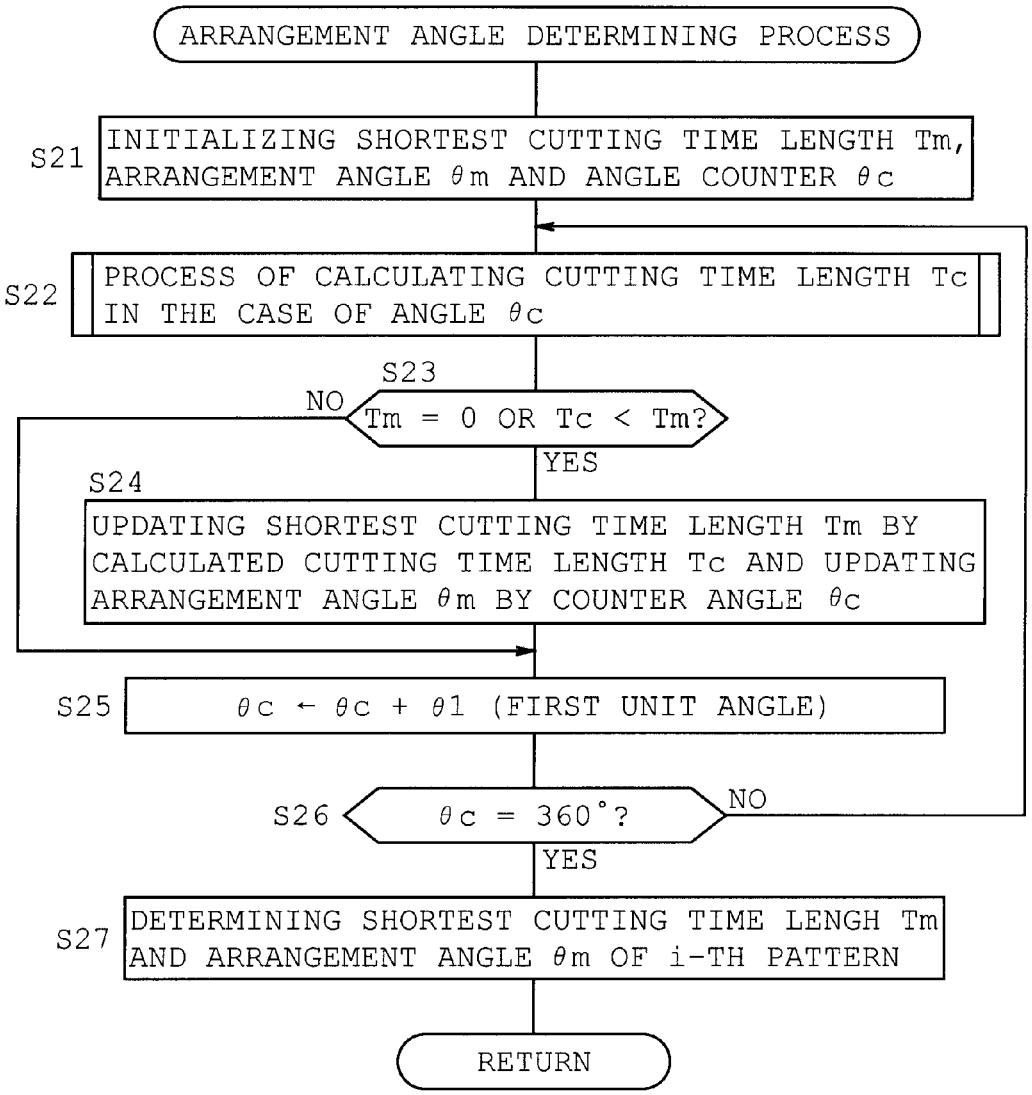
FIG. 12 is a flowchart of an arrangement angle determining process.
Figure 13:
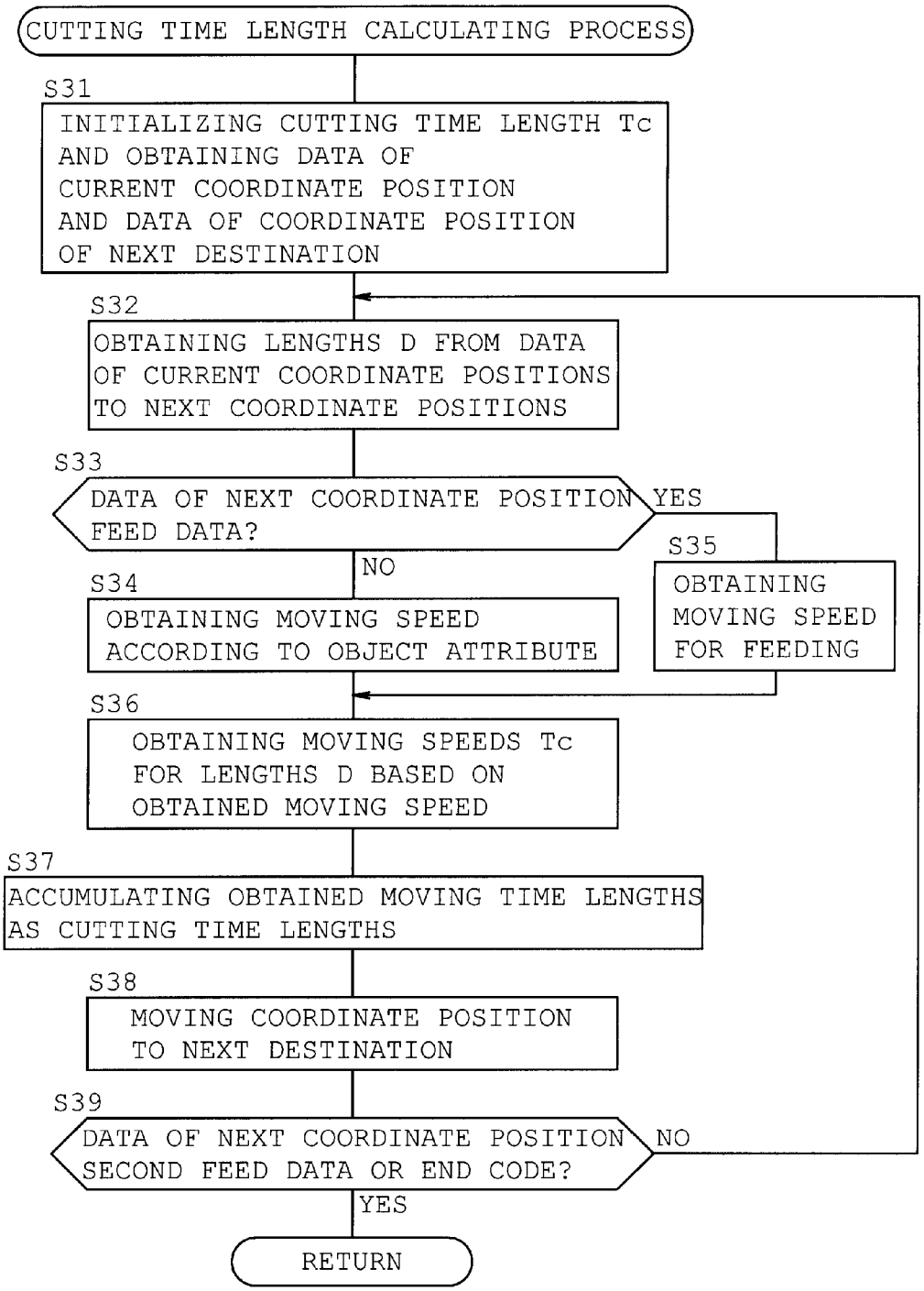
FIG. 13 is a flowchart of a cutting time calculating process.

When the cutting time lengths Tc of the line segments L1 to L4 are accumulated regarding the pattern A1 in the case where the angle counter θc is set at 1 (YES at step S39), the control circuit 61 returns to step S23 in FIG. 12. The cutting time length Tc of the pattern A1 is shorter than the shortest cutting time length Tm in the case where the arrangement angle θm is set to 0 (YES at step S23). Hence, the values of the shortest cutting time length Tm and the arrangement angle θm are updated to the cutting time length Tc and the value 1 of the angle counter θc respectively (step S24).

Subsequently, the angle counter θc is incremented by 1 (step S25 and NO at step S26), and the step S22 is executed. As a result, a cutting time length Tc in the case where the arrangement angle of the pattern A1 is set to 2° is calculated. Thus, the steps S22 to S26 are repeatedly executed in the case where the angle counter θc indicates 2 and so on, that is, the arrangement angle of the pattern A1 is set to 2° to 359°, so that the cutting time length Tc of the pattern A1 is calculated when the arrangement angle takes each of 2° to 359°. In the case of the pattern A1, the shortest cutting time length Tm is obtained when the angle counter θc indicates each one of 45, 135, 225 and 315, as shown in FIG. 7B. Accordingly, when the angle counter θc has counted 360 (YES at step S26), the shortest cutting time length Tm is obtained at the count of 45, so that the arrangement angle θm is determined to be 45° regarding the first pattern A1 (step S27 and return to step S14).

At step S14 in FIG. 11, the control circuit 61 converts coordinate data including the feed data of the pattern A1, based on the determined arrangement angle θm, causing the RAM 63 to store the converted coordinate data. In this conversion, points $P_0$ to $P_4$ of the pattern A1 as shown in FIG. 7A are rotated 45° about the center point $M_0$, whereby a coordinate conversion is executed. As a result, the postconversion pattern A1 as shown in FIG. 7B is cut with the shortest cutting time length Tm being applied. More specifically, it is assumed that both speed data Vx and Vy are set to 1 cm/sec and that the lengths of all the line segments L1 to L4 of the pattern A1 are set to 14 cm. In this case, since it takes 1.4 seconds to cut each one of the line segments L1 to L4, the cutting time length of the pattern A1 in FIG. 7A amounts to 5.6 seconds (1.4 sec×4). On the other hand, the pattern A1 having the arrangement, angle θm of 45° is composed of the line segments L1 to L4 each of which has reduced X-direction and Y-direction lengths as shown by symbol "Db" in FIG. 7B. Accordingly, when the cutter 6 is relatively moved simultaneously in the X-direction and the Y-direction, the time length required to cut each of the line segments L1 to L4 is 1.0 sec and the time length required to cut the pattern A1 becomes 4 sec (1.0 sec×4; and see FIG. 9). Consequently, the cutting time length of the pattern A1 is reduced by 1.6 sec (5.6 sec−4.0 sec=1.6 sec).

Subsequently, the counter i counts up (NO at step S15; and step S12) in the same manner as in the first pattern A1, and the process of determining an arrangement angle θm at which the shortest cutting time length Tm is obtained is executed regarding a second pattern A2 (step S13). In this case, the shortest cutting time length Tm, the arrangement angle θm and the angle counter θc are initialized (step S21 in FIG. 12), and the steps S22 to S26 are repeatedly executed regarding the second pattern A2. The pattern A2 is rotated by the first unit angle θ1 about the center point $M_0$, so that the cutting time lengths Tc of the pattern A2 are calculated regarding the respective arrangement angles. Since the second pattern A2 has the same configuration as the first pattern A1, the same shortest cutting time length Tm and the same arrangement angle θm of 45° as the first pattern A1 are determined regarding the second pattern A2 (step S27; and return to step S14). Further, coordinate conversion is executed regarding the coordinate data of the pattern A2, based on the determined arrangement angles θm (step S14).

Thus, the control circuit 61 repeatedly executes the steps S12 to S15 until the counter i determines that the count value corresponds with the pattern number n (YES at step S15). As a result, the control circuit 61 determines the shortest cutting time length Tm and the arrangement angle θm with respect to each of the patterns A1 to A80 and executes the coordinate conversion based on the arrangement angle, thereby generating new cutting data (full data).

Further, when completing the above-described cutting time length reducing process (step S4 in FIG. 10), the control circuit 61 causes the display 9*a* to display an arrangement display screen (step S5). As shown in FIG. 9, the arrangement display screen includes an arrangement angle display area 70 representing the patterns A1 having the respective arrangement angles of 0° and 45° and a cutting time length display area 71 displaying the cutting time lengths at the respective arrangement angles. The cutting time display area 71 displays a total cutting time length of all the patterns A1 to A80 as well as the cutting time length of a single pattern A1. The total cutting time length can be accurately calculated during execution of steps S31 to S39 based on coordinate data in the case where the arrangement angle is 0° and 45°.

More specifically, for example, a travel time length of the cutter 6 between the pattern A1 and the pattern A2 is calculated while the above-mentioned up-down movement time length of the cutter 6 is added to a time length calculated based on the coordinate data of the cutting end point $P_4$ of the pattern A1 and the cutting start point $P_0$ of the pattern A2 and the time length calculated based on the speed data Vx and Vy in the feed. Further, the control circuit 61 is configured as a first calculation unit which calculates the first cutting time length of each one of the patterns A1 to A80 at each of the arrangement angles in the case where each pattern is rotated by the first unit angles θ1. Accordingly, the accurate total cutting time length can be calculated by accumulating the cutting time lengths of the line segments L1 to L4 of the patterns A1 to A80; and the travel time lengths of the cutter 6 between the patterns without the cutting regarding the cases where the arrangement angle is 0° and 45° respectively.

Figure 6B:
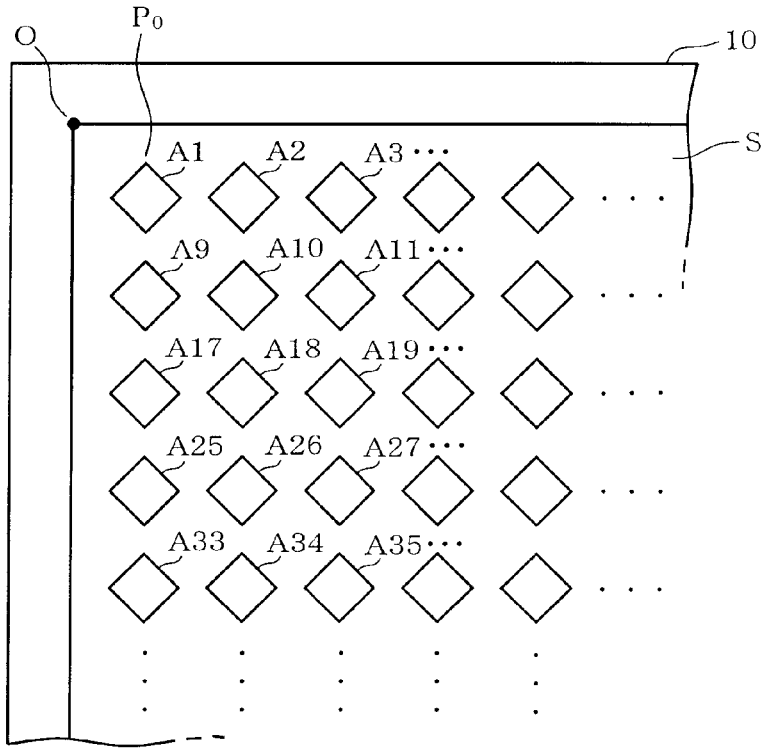

When the touch panel 9*c* is operated so that start of the cutting is instructed (YES at step S6), the control circuit 61 then executes the cutting operation based on newly generated full data (step S7). In this case, the cutter 6 is relatively moved simultaneously in the X and Y direction at speeds Vx and Vy respectively, so that the line segments L1 to L4 of the patterns A1 to A80 are cut in the shortest cutting time lengths Tm. Thus, as shown in FIG. 6B, the cutting lines of the patterns A1 to A80 are formed with the arrangement angle of 45° with the result that the cutting time length is reduced to be shorter than the case where the cutting lines are formed with the arrangement angle as shown in FIG. 6A.

Upon completion of the cutting of all the patterns A1 to A80, the control circuit 61 controls the transfer mechanism 7 so that the holding sheet 10 is transferred forward to be discharged (step S8), ending a series of processes (END).

The control circuit 61 serves as a determination unit which determines the arrangement angle θm at which the cutting time length (the first cutting time length) calculated by the control circuit 61 as the first calculation unit from the arrangement angles becomes shortest regarding the arrangement of the patterns A1 to A80 on the object S (see steps S22 to S27).

Further, the determination unit may determine the arrangement angle θm that is not more than a predetermined first threshold, regarding the cutting time length Tc calculated by the first calculation unit from the arrangement angle. More specifically, a predetermined rate (80%, for example) of the cutting time length of the pattern at the original arrangement angle (0°) is set as the first threshold. In this case, a step to determine whether or not the cutting time length Tc calculated by the first calculation unit is not more than the first threshold is added after step S24. When the cutting time length Tc is not more than the first threshold (when the counted value of the angle counter θc has reached 37 in the case of the above-described pattern), the control circuit 61 proceeds to step S27 to determine the arrangement angle θm. According to this, a computing time length to determine the arrangement angle θm can be reduced to a large extent since the steps S22 to 326 need not be executed with respect to the angle θc ranging from 1° to 359° for the purpose of obtaining the arrangement angle θm.

As understood from the foregoing, the cutting apparatus 1 includes the determination unit which determines the arrangement angle θm at which the first cutting time length calculated by the first calculation unit from the arrangement angles becomes shortest or not more than the first threshold regarding the arrangement of the patterns A1 to A80 on the object S (see steps S22 to S27). The cutting apparatus 1 also includes the cutting control unit which controls the moving device 20 so that the pattern arranged at the arrangement angle θm determined by the determination unit is cut out of the object S. The cutting control unit controls the moving device 20 so that the cutter 6 and the object S are moved simultaneously in the first and second directions, whereby the pattern arranged at the arrangement angle θm determined by the determination unit is cut.

According to this, the pattern is determined to be arranged on the object S at the arrangement angle θm at which the first cutting time length becomes shortest of the arrangement angles obtained by rotating the pattern by the first unit angles θ1 or not more than the predetermined first threshold. For this reason, when the pattern is cut by the use of the determined arrangement angle θm, the cutter 6 and the object S are moved simultaneously in the first and second directions, with the result that the cutting time length of the pattern can be reduced. Accordingly, the cutting time length can be reduced even when a single pattern is cut.

The cutting apparatus 1 includes the storage unit storing a plurality of types of patterns and a pattern designating unit designating a desired one of the patterns. First calculation unit calculates the first cutting time length regarding the pattern designated by the pattern designation unit. According to this configuration, the pattern whose cutting time length is to be reduced can be designated by the pattern designation unit.

The control circuit 61 is configured as a display control unit causing the display unit to display on the display unit the arrangement angle θm of the pattern determined by the control circuit 61 as the determination unit and the first cutting time length Tm in which the pattern is cut at the arrangement angle θm. According to this configuration, the arrangement angle θm determined by the determination unit and the first cutting time length Tm calculated by the first calculation unit can be displayed on the display unit.

The moving device 20 includes the transfer mechanism 7 transferring the object in the first direction and the head moving mechanism 8 moving the cutting head in the second direction perpendicular to the first direction. According to this construction, the transfer mechanism 7 and the head moving mechanism 8 are controlled by the cutting control unit so as to be moved simultaneously in the first and second directions, with the result that the cutting time length can be reduced.

Further, in the above-described cutting time length reducing process, the arrangement angle θm is determined for each of the patterns A1 to A80 (steps S12 to S15). Accordingly, the shortest cutting time length Tm can he calculated for each pattern according to the configuration of the pattern with the resale that the whole cutting time length can be reduced as much as possible.

Figure 15:
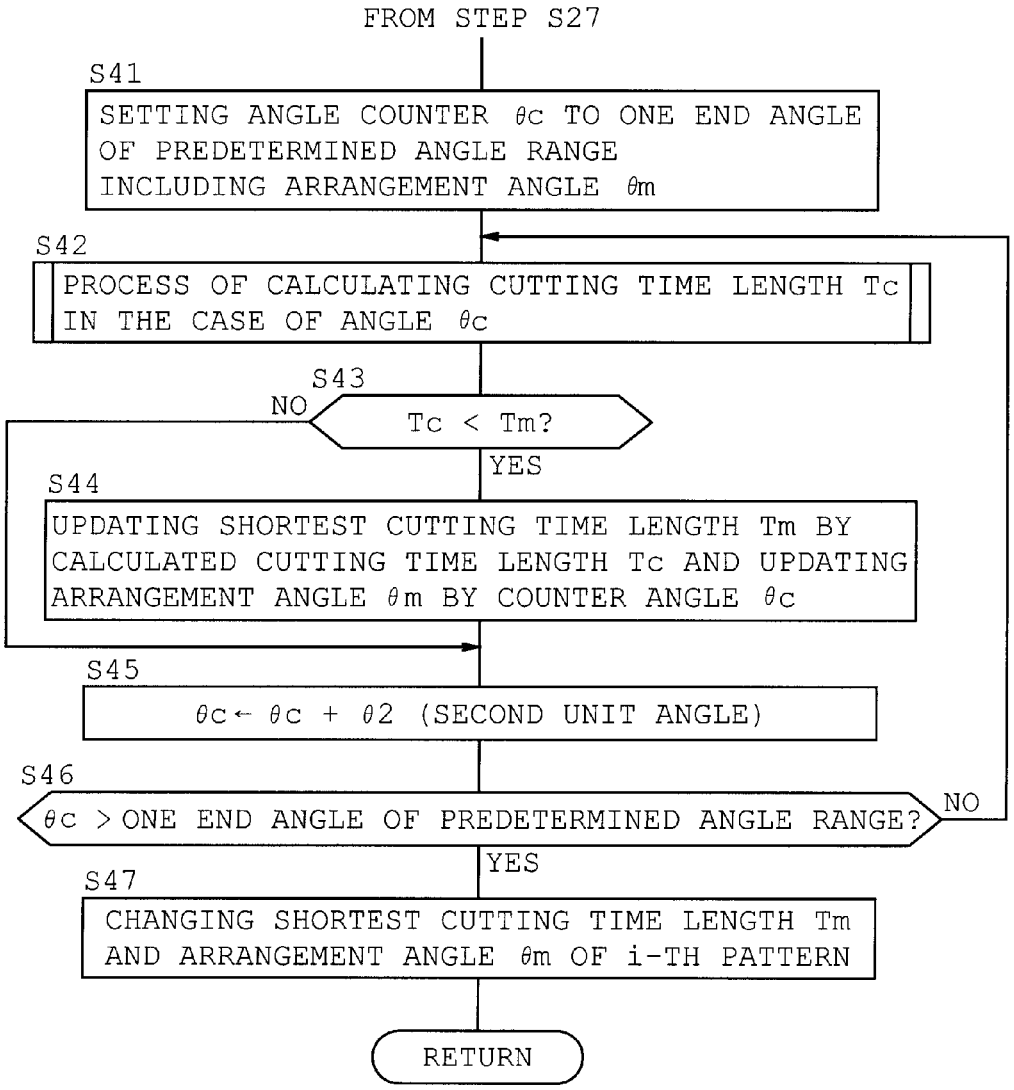
FIG. 15 is a flowchart of an arrangement angle determining process additionally executed in a second embodiment.
Figure 16:
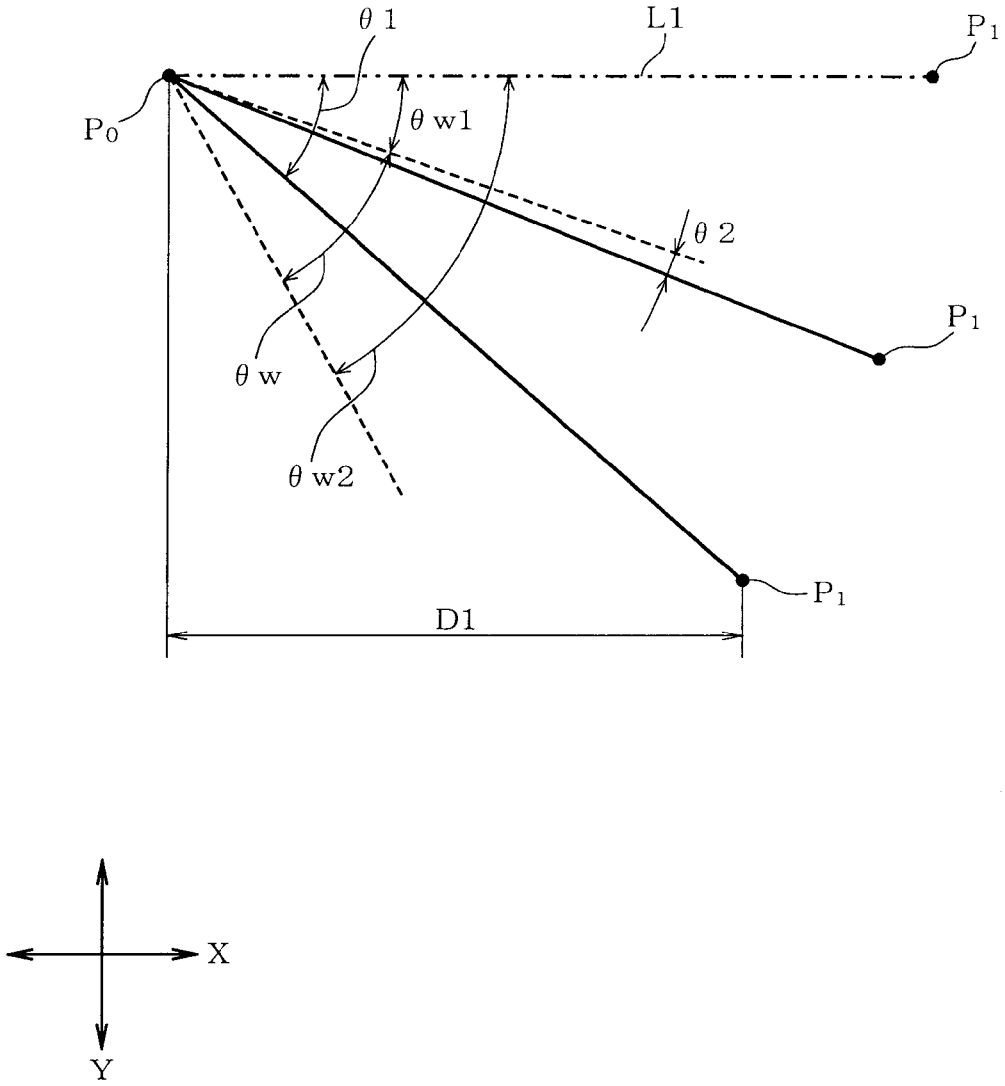
FIG. 16 is a diagrammatic view for explaining a second unit angle.

FIGS. 15 and 16 illustrate a second embodiment. In the second embodiment, identical or similar parts are labeled by the same reference symbols as those in the first embodiment and the description of these parts will be eliminated, and only the differences between the first and second embodiments will be described.

In the second embodiment, the first unit angle θ1 is set to a relatively larger value (40°, for example) as shown in FIG. 16. In this case, steps S22 to S26 are repeatedly executed regarding the pattern A1, so that the X-direction length of the line segment L1 is determined to be D1 (see FIG. 16) at the arrangement angle θm of 40° (step S27). In the second embodiment, the following processes are executed subsequently to step S27 in order that the pattern A1 may be rotated by a second unit angle S2 within a predetermined angle range θw including the arrangement angle θm.

More specifically, the control circuit 61 sets an angular range θw which is the same as the first unit angle θ1 (that is, a range of 40°) and has a first end located at a position of an angle θw1 smaller than the arrangement angle θm by, for example, 20° and a second end located at a position of an angle θw2 larger than the arrangement angle θm by, for example, 20°. The control circuit 61 also sets the angle counter θc to the angle θw1 of the first end of the angular range θw (step S41 in FIG. 15). Next, the same processing as at step S22 is executed at step S42, so that the cutting time length Tc (second cutting time length) is calculated in the case where the arrangement angle of the pattern A1 is set to 20° (=40°−20°). Since the cutting time length Tc of the pattern A1 is longer than the shortest cutting time length Tm in the case where the arrangement angle θm is 40° (NO at step S43), the control circuit 61 proceeds to step S45 without updating the shortest cutting time length Tm and the arrangement angle θm.

Subsequently, the control circuit 61 increments the angle counter θc by a second unit angle θ2 (1°, for example) that is smaller than the first unit angle θ1 (step S45 and NO at step S46). As a result, the arrangement angle of the pattern A1 is changed from 20° located at the first end of the angular range θw to 21° (see FIG. 16), calculating the cutting time length Tc (step S42). Thus, steps S42 to S46 are executed repeatedly regarding count values of not less than 2, that is, the arrangement angle of the pattern A3, ranging from 21° to 60°. As a result, the cutting time length Tc of the pattern A1 at each of the arrangement angles is calculated. In this case, the shortest cutting time length Tm is obtained when the count value of the counter θc is 45. Accordingly, when the angle counter θc has been determined to have exceeded the second end of the angular range θw or 60° (YES at step S46), the arrangement angle θm of 40° and the shortest cutting time length Tm both determined at step S27 are changed to the arrangement angle θm of 45° and the shortest cutting time length in the case of 45° arrangement angle.

The control circuit 61 serves as a second calculation unit calculating a second cutting time length required for the cutting of the pattern at the arrangement angles in the case where the pattern is rotated by the second unit angles θ2, within the predetermined angular range θw including the arrangement angle θm determined by the control circuit 61 serving as the determination unit. Further, the control circuit 61 serves as a change unit changing the arrangement angle determined by the determination unit to an arrangement angle at which the cutting time lengths (the first cutting time length and second cutting time length) calculated as the first and second calculation units become shortest.

The change unit may change the arrangement angles so that the arrangement angles are equal to or smaller that a predetermined second threshold regarding the cutting time lengths calculated by the first and second calculation units. More specifically, a predetermined rate (70%, for example) of the cutting time length of the pattern at the original arrangement angle (0°) may be set as the second threshold. In this case, after step S44, it is determined whether or not the cutting time lengths Tc calculated by the first and second calculation units are not more than the second threshold. When the cutting time lengths Tc are not more than the second threshold, the control circuit 61 proceeds to step S47 to change the arrangement angle to the arrangement angle θm in the case where the cutting time length Tc is not more than the second threshold.

According to the second embodiment described above, an arrangement angle of the pattern which can reduce the cutting time length can be set using the first unit angle θ1 and the second unit angle θ2. Accordingly, when the first and second unit angles θ1 and θ2 are set to appropriate values, the arrangement angle θm and the shortest cutting time length Tm can be calculated efficiently with the result that the calculating time length can be reduced as much as possible. Further, even when a single pattern is to be cut, the cutting time length can be reduced. Thus, the second embodiment can achieve the same advantageous effects as the first embodiment.

The foregoing embodiments should not be restrictive and may be modified or expanded as follows. The invention should not be limited to the above-described cutting apparatus 1 and may be applied to various types of apparatuses each of which is provided with a moving device relatively moving the cutting blade and the object S in the first direction and the second direction differing from the first direction.

The second unit angle θ2 may be any angle smaller than the first unit angle θ1 (θ2<θ1). The first and second unit angles θ1 and θ2 may be set to any respective suitable values. Further, the first and second thresholds should not be limited to the foregoing values and maybe set to any respective suitable values. The cutting time lengths need not be calculated until the angle counter θc reaches 360 at step S26 (that is, until the pattern is rotated one turn). For example, an upper limit of the angle counter θc may be set to 180 (or 45) depending upon the configuration of the pattern. The control circuit 61 may determine the shortest cutting time length Tm and the arrangement angle θm when determining that the pattern has been rotated 180° or 45° (YES at step S26).

The storage unit should not be limited to the ROM 62 or the external memory 65 and may be another internal storage unit incorporated in the cutting apparatus 1 or another external storage unit detachably attached to the cutting apparatus 1. Further, the display unit may display either the arrangement angle display area 70 or the cutting time length display area 71. The arrangement angle of the pattern may be indicated by numeric values, instead of an outline of the pattern as shown in FIG. 9.

The processing program stored in the storage unit in the cutting apparatus 1 may be stored in a non-transitory computer-readable storage medium including a USB memory, a CD-ROM, a flexible disc, a DVD and a flash memory. In this case, the processing program stored in the storage medium is read by computers of the apparatuses provided with the moving devices and cutting units thereby to be executed, with the result that the same advantageous effects as in the foregoing embodiments can be achieved.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

I claim:

1. A cutting apparatus cutting a pattern out of an object, comprising:

a moving device configured to move a cutting blade and the object in a first direction relative to each other and in a second direction differing from the first direction, relative to each other; and a control device configured to cause the apparatus to:

calculate first cutting time lengths required to cut the pattern at a plurality of arrangement angles in a case where an arrangement angle of the pattern relative to the first or second direction is changed by a predetermined first unit angle;

determine one of the arrangement angles, which is shortest with respect to the first cutting time length or not more than a first predetermined threshold; and control the moving device so that the movement of the cutting blade in the first direction and the movement of the object in the second direction are simultaneously executed, whereby the pattern is cut at the determined arrangement angle.

2. The cutting apparatus according to claim 1, further comprising:

a storage unit configured to store data of a plurality of types of patterns; and a pattern designating unit configured to designate a desired one of the patterns stored in the storage unit, wherein the control device is further configured to cause the cutting apparatus to calculate the first cutting time length of the designated pattern.

3. The cutting apparatus according to claim 2, wherein the control device is further configured to cause the cutting apparatus to;

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

4. The cutting apparatus according to claim 2, further comprising a display unit configured to display at least information about cutting of the pattern, wherein the control device is further configured to cause the cutting apparatus to further cause the display unit to display the arrangement angle of the determined pattern and/or the first cutting time length in the case of the arrangement angle of the determined pattern.

5. The cutting apparatus according to claim 4, wherein the control device is further configured to cause the cutting apparatus to:

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

6. The cutting apparatus according to claim 1, further comprising a display unit configured to display at least information about cutting of the pattern, wherein the control device is further configured to cause the cutting apparatus to further cause the display unit to display the arrangement angle of the determined pattern and/or the first cutting time length in the case of the arrangement angle of the determined pattern.

7. The cutting apparatus according to claim 6, wherein the control device is further configured to cause the cutting apparatus to;

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

8. The cutting apparatus according to claim 1, wherein the control device is further configured to cause the cutting apparatus to:

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined, arrangement angle; and change the determined arrangement angle to an arrangement angle which is shortest with respect to the first and second cutting time lengths or not more than a predetermined second threshold.

9. The cutting apparatus according to claim 1, wherein the moving device includes a transfer mechanism configured to transfer the object in the first direction and a head moving mechanism configured to move the cutting head having the cutting blade in the second direction intersecting with the first direction.

10. A non-transitory computer-readable medium, storing a program for a cutting apparatus comprising:

a moving device configured to move a cutting blade and the object in a first direction relative to each other and in a second direction differing from the first direction, relative to each other; and a control device, wherein the program causes the control device to execute instructions which, when executed, cause the apparatus to:

calculate first cutting time lengths required to cut the pattern at a plurality of arrangement angles in a case where an arrangement angle of the pattern relative to the first or second direction is changed by a predetermined first unit angle;

determine one of the arrangement angles, which is shortest with respect to the first cutting time length or not more than a first predetermined threshold; and control the moving device so that the movement of the cutting blade in the first direction and the movement of the object in the second direction are simultaneously executed, whereby the pattern is cut at the determined arrangement angle.

11. The medium according to claim 10, wherein the cutting apparatus further comprises:

a storage unit configured to store data of a plurality of types of patterns; and a pattern designating unit configured to designate a desired one of the patterns stored in the storage unit, and wherein the instructions, when executed by the control device, further cause the apparatus to cause the cutting apparatus to calculate the first cutting time length of the designated pattern.

12. The medium according to claim 11, wherein the instructions, when executed by the control device, further cause the cutting apparatus to:

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

13. The medium according to claim 11, wherein the cutting apparatus further comprises:

a display unit configured to display at least information about cutting of the pattern, and wherein the instructions, when executed by the control device, further cause the cutting apparatus to cause the display unit to display the arrangement angle of the determined pattern and/or the first, cutting time length in the case of the arrangement angle of the determined pattern.

14. The medium according to claim 13, wherein the instructions, when executed by the control device, further cause the cutting apparatus to:

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

15. The medium according to claim 10, wherein the cutting apparatus further comprises:

a display unit configured to display at least information about cutting of the pattern, and wherein the instructions, when executed by the control device, further cause the apparatus to cause the display unit to display the arrangement angle of the determined pattern and/or the first cutting time length in the case of the arrangement angle of the determined pattern.

16. The medium according to claim 15, wherein the instructions, when executed by the control device, further cause the cutting apparatus to:

calculate second cutting time lengths required to cut the pattern at a plurality of arrangement angles in a case where an arrangement angle of the pattern relative to the first or second direction is changed by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

17. The medium according to claim 10, wherein the instructions, when executed by the control device, further cause the cutting apparatus to:

calculate second cutting time lengths required to out the pattern at a plurality of arrangement angles in a case where an arrangement angle of the pattern relative to the first or second direction is changed, by a predetermined second unit angle smaller than the first unit angle, within a predetermined angular range including the determined arrangement angle; and change the determined arrangement angle to an arrangement angle which is shortest with respect to the first and second cutting time lengths or not more than a predetermined second threshold.

* * * * *